US011701562B2

(12) United States Patent
Kapsalis

(10) Patent No.: US 11,701,562 B2
(45) **Date of Patent: *Jul. 18, 2023**

(54) IN-GOAL BALL RETURN OR COLLECTION DEVICE

(71) Applicant: Jeffrey Christian Kapsalis, Shelburne, VT (US)

(72) Inventor: Jeffrey Christian Kapsalis, Shelburne, VT (US)

( * ) Notice: Subject to any disclaimer, the term of this patent is extended or adjusted under 35 U.S.C. 154(b) by 21 days.

This patent is subject to a terminal disclaimer.

(21) Appl. No.: 16/874,049

(22) Filed: May 14, 2020

(65) Prior Publication Data

US 2020/0269106 A1 Aug. 27, 2020

Related U.S. Application Data

(63) Continuation-in-part of application No. 15/711,427, filed on Sep. 21, 2017, now Pat. No. 10,709,947.

(51) Int. Cl.

| | |
|---|---|
| ***A63B 69/00*** | (2006.01) |
| ***A63B 63/00*** | (2006.01) |
| *A63B 102/14* | (2015.01) |

(52) U.S. Cl.

CPC ..... *A63B 63/004* (2013.01); *A63B 69/002* (2013.01); *A63B 2063/001* (2013.01); *A63B 2102/14* (2015.10); *A63B 2209/00* (2013.01); *A63B 2210/50* (2013.01); *A63B 2225/09* (2013.01)

(58) Field of Classification Search

CPC ..... A63B 69/002; A63B 2063/001; A63B 2209/00; A63B 2210/50; A63B 2225/09; A63B 2102/14

USPC ..... 473/422, 446, 432, 434, 435, 438, 473/476–478

See application file for complete search history.

(56) References Cited

U.S. PATENT DOCUMENTS

| | | | | |
|---|---|---|---|---|
| 331,756 | A | 12/1885 | Baker | |
| 1,544,110 | A * | 6/1925 | Stall | A63B 69/345 473/444 |
| 1,566,945 | A | 12/1925 | Winkley | |
| 2,485,781 | A * | 10/1949 | Schreiber | A01K 77/00 43/12 |
| 2,667,996 | A * | 2/1954 | Fanelli | A45F 4/02 224/153 |
| 3,001,795 | A | 9/1961 | Johnson, Jr. | |
| 3,942,795 | A | 3/1976 | Penska | |
| 4,083,561 | A | 4/1978 | Daffer, Jr. | |
| 4,286,786 | A | 9/1981 | Papadopoulus | |
| 4,417,728 | A | 11/1983 | Hay et al. | |

(Continued)

OTHER PUBLICATIONS

International Search Report for International Application No. PCT/US2018/067362, dated Dec. 21, 2018, 15 pages.

*Primary Examiner* — Mitra Aryanpour
(74) *Attorney, Agent, or Firm* — Thomas G. Ference

(57) ABSTRACT

An in-goal ball return device, the ball return device is a material implement having a front edge, side edges, and a rear edge. The device is configured for attachment within a goal, the goal having a supporting net mesh. The device has a plurality of closed loops disposed along the rear edge and side edges. The device includes a lacing cord for threading through any number of the closed loops and the net to secure the material implement to the net mesh. The device forms a continuous angled surface between the front and closed portion of the goal when attached.

19 Claims, 31 Drawing Sheets

(56) References Cited

U.S. PATENT DOCUMENTS 4,703,931 A * 11/1987 Steen ..... A63B 69/0097 473/435
4,842,284 A * 6/1989 Rushing ..... A63B 63/00 473/478
D302,991 S 8/1989 York
4,921,257 A 5/1990 Heller
5,042,820 A 8/1991 Ford
5,246,229 A 9/1993 Carey
D356,841 S 3/1995 Temple
5,494,297 A * 2/1996 MacNeil ..... A63B 49/10 473/513
5,549,304 A 8/1996 Davis et al.
5,558,338 A 9/1996 Taub
5,830,089 A 11/1998 Halter et al.
5,902,194 A * 5/1999 Wade ..... A63B 63/00 473/446
D426,597 S 6/2000 Akwei
6,165,085 A 12/2000 Lubin
6,447,410 B2 * 9/2002 Crawford ..... A63B 51/02 473/513
6,485,373 B1 * 11/2002 Stephens ..... A63B 63/00 473/197
7,121,965 B2 * 10/2006 Riley ..... A63B 63/004 473/478
7,523,942 B2 * 4/2009 Chung ..... A63B 24/0021 273/317.1
7,543,821 B2 * 6/2009 Winningham ..... A63B 63/004 473/435
D628,252 S 11/2010 Forrest, Sr. et al.
D779,602 S 2/2017 Hockberg
9,573,033 B2 2/2017 Surbrook
10,286,274 B1 * 5/2019 Carretta ..... A63B 71/0054 473/446
10,709,947 B2 * 7/2020 Kapsalis ..... A63B 63/004 473/446
2007/0281807 A1 12/2007 Cho
2008/0096695 A1 4/2008 Winningham et al.
2009/0029804 A1 1/2009 Crawley et al.
2010/0120557 A1 5/2010 Klein et al.
2012/0157239 A1 6/2012 Elpers
2012/0165140 A1 * 6/2012 Bound ..... A63B 59/20 473/513
2016/0199718 A1 * 7/2016 Holland ..... A63B 69/0097 473/435
2017/0189774 A1 * 7/2017 Ferrari ..... A63B 69/0002 473/446
2018/0214754 A1 * 8/2018 Conforti ..... A63B 71/022 473/446
2020/0269106 A1 * 8/2020 Kapsalis ..... A63B 63/004 473/446

* cited by examiner

IN-GOAL BALL RETURN OR COLLECTION DEVICE

CROSS-REFERENCE TO RELATED APPLICATIONS

This application is a continuation in part of U.S. patent application Ser. No. 15/711,427, filed on Sep. 21, 2017 and titled "In-Goal Ball Return or Collection Device", which is herein incorporated by reference.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD

One or more embodiments of the invention generally relate to sports equipment. More particularly, certain embodiments of the invention relate to an in-goal ball return or collection device that uses a lacing system configured to attach the device within the goal to the net mesh.

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that the retrieval of sport balls shot into goals can often be time consuming which may slow down or use up practice time or game time. In addition, during a typical practice, many practice balls may be needed to prevent repeatedly stopping to retrieve balls from out of the goal to continue practicing. Also, one may expect that retrieving balls can be particularly difficult and time consuming if there is a target device blocking the entrance of a goal. Said target devices typically comprise a piece of fabric stretched across the goal entrance with multiple holes to be used as targets for shooting a ball through as an alternative to having a person acting as a goalie. These devices normally block the entire entrance of the goal and make it quite challenging to remove balls that have "scored" or entered the goal. Due to the placement of such target devices in the entrance of the goal, the target device typically must be fully or partially removed, the entire goal must be moved, or each ball must be individually attained to retrieve balls. Furthermore, individuals that enter a goal to retrieve balls can be subject to being struck by other balls being shot into the goal.

By way of educational background, an aspect of the related technology generally useful to be aware of is that there are some currently available devices meant to return balls that enter a goal to the playing field. Many such devices may be provided as entire goal systems with built in ball returns. In addition these devices are often configured to be specific to a particular sport such as, but not limited to, soccer or lacrosse. One such device comprises a ball return made of a ridged material that is typically not removable. One can expect that failure to appropriately integrate the ball return into the goal netting may result in balls becoming caught between the net and the ball return. Another such device may be configured to be mechanized in nature. This device and many other current devices may be difficult to employ during an actual game as they may hinder the use of the goal.

In view of the foregoing, it is clear that these traditional techniques are not perfect and leave room for more optimal approaches.

SUMMARY

In one implementation, the present disclosure is directed to a device for placement within a goal to return balls, the goal having a fame supporting a net mesh. The device comprises a material implement that has a front edge, side edges and a rear edge. A plurality of closed loops is disposed along the rear edge and side edges of the material implement. The device further comprises a lacing cord for threading through any number of the closed loops and the net to secure the material implement to the net.

In another implementation, the present disclosure is directed to a sport net lacing system. The sport net lacing system is comprised of a first net mesh having strands of material defining first open spaces and a second net mesh having strands of material defining second open spaces. The system further comprises a lacing cord for threading through any number of the first and second open spaces to secure the first and second nets together.

In yet another implementation, the present disclosure is directed to a sport net lacing system. The lacing system comprises a net mesh having strands of material defining open spaces and a frame having frame loops. The system further comprises a lacing cord for threading through any number of the open space and the frame loops.

BRIEF DESCRIPTION OF DRAWINGS

The present invention is illustrated by way of example, and not by way of limitation, in the figures of the accompanying drawings and in which like reference numerals refer to similar elements and in which:

FIG. 1A is a diagrammatic side view for one embodiment of the ball return device, and FIG. 1B is a diagrammatic side view of one embodiment of the ball return device in which a retention flap is engaged;

FIG. 2A is a front perspective view, and FIG. 2B is a rear perspective view;

FIG. 4A is a diagrammatic front view, FIG. 4B is a diagrammatic side view, FIG. 4C is a diagrammatic front angled view and FIG. 4D is a diagrammatic bottom left rear goal view;

FIG. 7A is a diagrammatic side view. FIG. 7B is a diagrammatic top view, and FIG. 7C is a diagrammatic front view;

FIG. 8A is a front perspective view, and FIG. 8B is a partially cut away top view of a rear corner of the ball return device;

FIG. 9A is a side perspective view of a front corner of the ball return device, and FIG. 9B is a rear perspective view of a rear edge of the ball return device;

FIG. 10A is a diagrammatic front view of the ball return device attached to a goal, and FIG. 10B is a partially transparent top view of a front corner of the ball return device;

FIG. 11A is a side perspective view of a rear corner of the ball return device, FIG. 11B is a side perspective close up view of attachment hooks, FIG. 11C is a perspective view of a ball return device net attachment, FIG. 11D is a perspective view of a ball return device to goal netting of a lacrosse goal post, FIG. 11E is a perspective view of a net to frame attachment, FIG. 11F is a perspective view of a net to frame attachment, FIG. 11G is a perspective view of a net to frame attachment.

FIG. 16A is a side perspective view of a lacrosse goal 1600 where the exemplary ball return device design is integrated to and suspended from the goal netting only and FIG. 16B is a side perspective of a soccer goal with an exemplary ball return device supported by the goal or net support frame or net support;

FIG. 20A is a front perspective view of the ball return device. FIG. 20B is an enlarged view of the region 20B. FIG. 20C is front view of the ball return device not attached to the net. FIG. 20D is a back view of the ball return device not attached to the net. FIG. 20D is a side view of the ball return device not attached to the net and showing reinforcing elements;

Figure 1A:
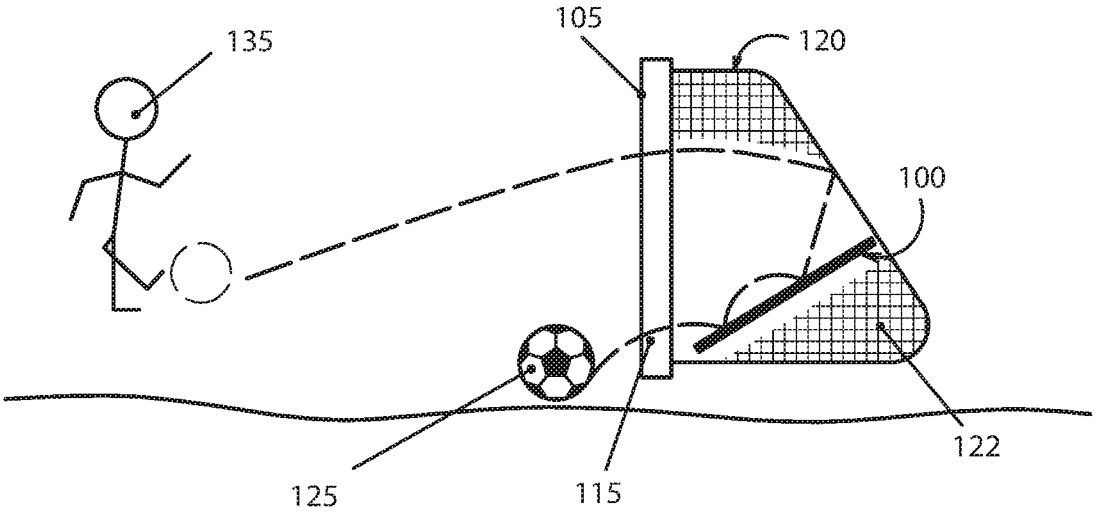
FIGS. 1A and 1B illustrate an exemplary in-goal ball return device in use in a soccer goal, in accordance with an embodiment of the present invention.

Unless otherwise indicated illustrations in the figures are not necessarily drawn to scale.

DETAILED DESCRIPTION

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms “a,” “an,” and “the” include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib.

Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an in-goal ball return or collection device. Some embodiments may be configured as a portable accessory for sport goals which may be easily installed or removed. Some embodiments may also provide a surface for marketing or promotion. It is contemplated that some embodiments can be adapted for use with several different types of sports and sports goals including, without limitation, soccer, lacrosse, field hockey, hand ball, street hockey and ice hockey. Moreover, some embodiments may be used with goals of various different types, designs, and manufacturers for each sport.

Figure 1B:
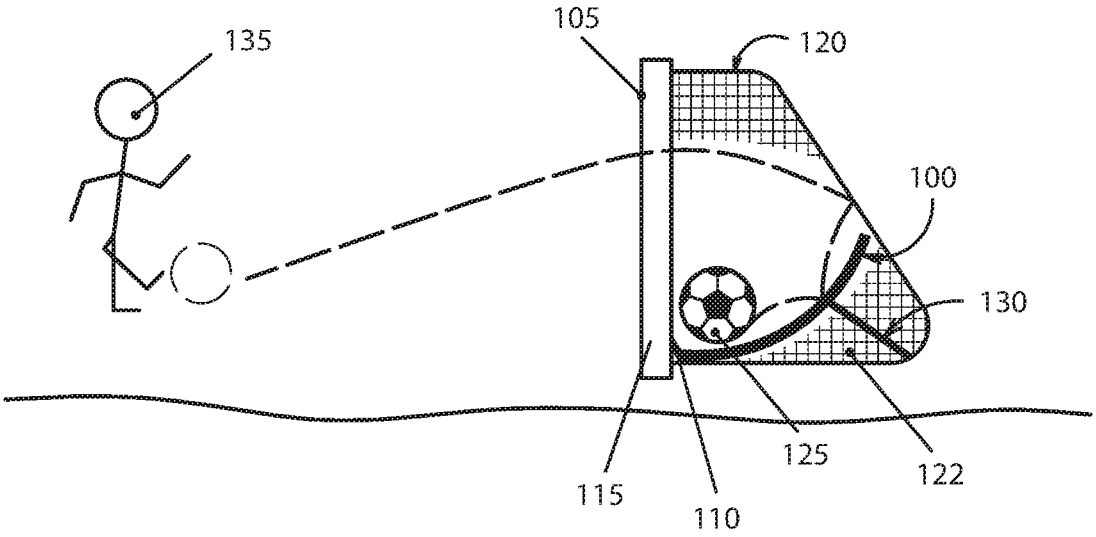

FIGS. 1A and 1B illustrate an exemplary in-goal ball return device 100 in use in a soccer goal structure 105, in accordance with an embodiment of the present invention. FIG. 1A is a diagrammatic side view, and FIG. 1B is a diagrammatic side view in which a retention flap 110 is engaged. In the present embodiment, ball return device 100 comprises a substantially flat material, for example, a single or a multi piece system of fabric or fabric sections, the front edge of which may be attached to the bottom of each side goal post 115 so that the fabric runs substantially tightly along the ground between posts 115. In addition, the side and rear edges of the ball return device 100 may be attached along the interior of a goal netting 120 in multiple locations from a preferred angle range of about 15 degrees to about 45 degrees front to back so that the ball return device 100 forms a continuous angled surface from the goal opening between posts 115 where ball return device 100 is at ground level to the rear of the goal where ball return device 100 is attached approximately $\frac{1}{8}^{th}$ to ½ of the way up (i.e., above ground level) the netting or rear goal frame 120. It is contemplated that the location of the attachment point of ball return device 100 at the rear of the goal may vary in different applications to create a range of slopes for the angled surface of ball return device 100. Furthermore, the slope of the angled surface may be fixed or may be adjustable. Being able to adjust the slope may enable a user to adjust the effectiveness of ball return device 100 or the rate of speed in which a ball 125 travels down the angled surface. This adjustability may be achieved by changing the attachment positions of the fasteners that connect ball return device 100 to goal frame, goal netting or goal and net support frame 120. In FIGS. 1A and 1B 115 and 105 are the goal frame and 120 is more of the goal and goal net support frame. Both 105 and 120 can be used to attach the device to. Changing the device connection points higher on the rear more vertical section of 120 may increase the angle of the device surface. If the connection points on the goal frame change the device attachment points on the goal netting will need to change as well. The "frame" of the device for this goal and most soccer goals would consist of the webbing straps sewn in around the perimeter of the device as shown in 9A and 9 B. The straps would attach to 4 different points (one in each of the "corner" points of the goal and support frame, the straps would be tightened using the buckles to pull the device tight within the goal and give it the proper shape and taught-ness or by changing the length of the fastener cords or straps which join the ball return device 100 to the goal 105. For example, without limitation, in one variation the attachment fasteners may be located farther back behind goal posts 115, attached to goal and support frame 120 so that the bottom portion of ball return device 100 which touches the ground is several inches or several feet behind an imaginary line (or goal line) running between the two goal posts 115. In addition to creating the slope of the angled surface of ball return device 100, the attachment of ball return device 100 to goal netting 122 (detailed in FIGS. 9-11) may also add fluid integration between the angled surface and goal netting 122 to help prevent balls from fitting/falling between ball return device 100 and netting 122 and getting caught or trapped behind ball return device 100.

In the present embodiment, the fabric of ball return device 100 is typically pulled taut, relatively taught, to relatively loose but enough so to provide a surface along which ball 125 may easily roll in an intended direction. A reinforcing material around the edge of ball return device 100 and/or supporting or stretching from behind such as, but not limited to, nylon webbing straps, stiff mesh, tubing or poles may aid in achieving and maintaining the tautness i.e., substantial tightness, of ball return device 100. Some embodiments may comprise a rigid frame to maintain the tautness of the angled surface. Ball return device 100 may be stretched tight and substantially flat along its surface as illustrated by way of example in FIG. 1A, or one or more tension cords 130 may be connected to ball return device 100 to create a curvature as illustrated by way of example in FIG. 1B. The fabric may also hang, suspended, relatively loosely, attached to different points along the goal netting as in FIG. 16A (lacrosse goal example), goal frame, goal and net frame as in FIG. 16B (soccer goal example) or device frame as in FIGS. 17A and 17B as to provide this same general shape. Still referring to FIG. 1B, retention flap 110 may be formed by additional fabric added as a fixed or adjustable flap at the lower front portion of the angled surface of ball return device 110. Retention flap 110 can be optionally used or may be omitted from some implementations of ball return device 100. The material for the angled surface of ball return device 100 and retention flap 110 has been described as fabric; however, it is contemplated that a multiplicity of suitable materials may be used to form these elements. For example, without limitation, these elements may be made from a static material such as, but not limited to, a plastic tarpaulin, standard nylon netting, nylon screen, nylon mesh woven polypropylene, or canvas, or these elements may be made of a more elastic material such as, but not limited to, a multi-directional stretch fabric like spandex or neoprene, trampoline material, or rubber, silicone sheet or mesh material. It may be appreciated by a person with ordinary skill in the art, in light of and in accordance with the teachings of the present invention, that the material for the angled surface of the ball return device 100 may generally include, but not be limited to, a durable, flexible, forgiving, weather resistant, and relatively smooth material, off which the applicable ball may easily roll or slide along its surface. In an exemplary embodiment, it may be appreciated by a person with ordinary skill in the art, in light of and in accordance with the teachings of the present invention, that the material for the angled surface of the ball may include, but not be limited, to a material with holes that are small enough for a ball to roll well on and drain water, while at the same time the "threads" or strings may be close enough together that graphics may be printed on the surface, be vibrant and easily read.

Referring to FIG. 1A, in typical use of the preset embodiment, a ball 125 shot into goal 105 is directed back onto the field of play. When ball 125 is shot into goal 105, ball 125 may be stopped by goal netting 120 and/or ball return device 100. Then, ball 125 may drop or come to rest on the angled surface of ball return device 100 and roll by force of gravity towards the opening of goal 105 and out of goal 105. This may enable a player 135 or multiple players to continue playing or practicing with reduced interruptions as scored balls roll back out of goal 105 where players or coaches can quickly and easily retrieve them. This may also reduce the number of balls used in a practice as the use of ball return device 100 may make it less likely that balls will be collected at the back or side portions of the goal and net area. Referring to FIG. 1B, when retention flap 110 is engaged, the ball 125 may roll down the angled surface of the ball return device 100 and come to rest and at the front lower portion of the ball return device 100 where the ball 125 may be quickly and easily collected while not rolling completely outside the goal 105. The use of the retention flap 110 may be particularly useful when a goalie is defending the goal 105 during a practice. Multiple balls can be shot at the goal 105 while being defended by a goalie. Some of these balls will go into the goal 105. Having the retention flap 110 engaged normally may prevent the balls from rolling back into the field of play which may distract the goalie or become a tripping hazard. Moreover, the ball return device 100 typically does not hinder the normal flow, player performance, or rules of the game for which it is designed and may be used during an actual game.

It is believed that ball return device 100 may have advantages over current approaches that are implemented as complete goal systems since the present embodiment is implemented as an accessory that may be used with most any goal. Various embodiments may be added to almost any type or brand/manufacturer of sport goal including, without limitation, soccer goals, lacrosse goals, hand ball goals, field hockey goals, ice hockey, and street hockey goals. It is contemplated that each goal type would have a ball return device designed to fit its size and shape with a similar general functionality as the previously described embodiment. Many embodiments may be quickly and easily installed or removed and may be easily compacted and transported as these embodiments are often made primarily from lightweight materials such as, but not limited to, fabric, webbing, lacing, hook and loop materials and collapsible or segmented poles.

Figure 2A:
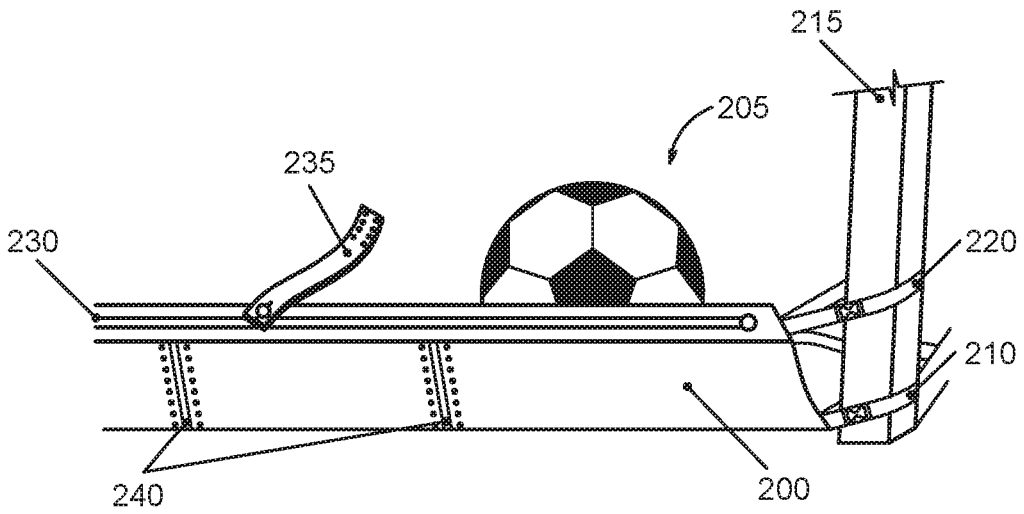
FIGS. 2A and 2B illustrate an exemplary retention flap of a ball return device, in accordance with an embodiment of the present invention.
Figure 2B:
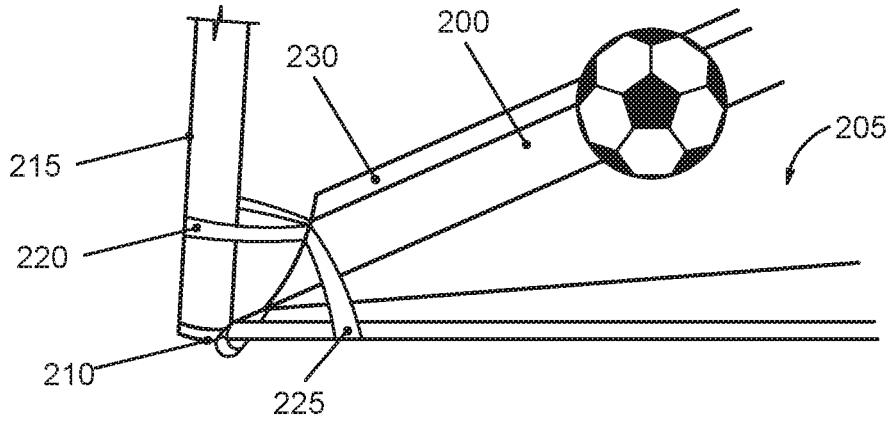

FIGS. 2A and 2B illustrate an exemplary retention flap 200 of a ball return device, in accordance with an embodiment of the present invention. FIG. 2A is a front perspective view, and FIG. 2B is a rear perspective view. In the present embodiment, retention flap 200 may be easily adjusted or disengaged so that when in the up position, as shown, balls cannot easily roll out of the goal opening and when in the down position, balls may roll over retention flap 200 and out of the goal. Retention flap 200 may be formed by additional fabric at the front portion of an angled surface 205 of the ball return device. Adjustable device straps 210 secure the front portion of angled surface 205 to a goal post 215, and adjustable retention flap straps 220 secure the top corners of retention flap 200 to goal posts 215. In addition, adjustable brace straps 225 may help keep retention flap 200 in the up position. Device straps 210 and retention flap straps 220 may comprise connection means such as, but not limited to, buckles, clamps, ties, bolts or snaps that may enable straps 210 and 220 to be wrapped around or secured to goal posts 215 goal support frame or ground stakes. Brace straps 225 may also comprise connection means that may enable brace straps to be unattached from retention flap 200 and/or angled surface 205 when retention flap is in the down position. The adjustability of device straps 210, retention flap straps 220, and brace straps 225 may enable the angle of retention flap 200 to be changed and may enable retention flap 200 to be attached to goals of various different configurations. In some alternate embodiments, some or all of these straps may be non-adjustable.

In the present embodiment, additional elements may optionally be incorporated into retention flap 200 for structural support such as, but not limited to, a flexible pole 230, similar to a tent pole, that may be embedded into or otherwise attached to the top edge of retention flap 200. In some embodiments, flexible pole 230 may slide into a pocket formed in the top edge of retention flap 200. Flexible pole 230 may be a single piece or multiple joined pieces. Other structural supports may include, without limitation, a support strap 235 that may attach retention flap 200 to angled surface 205 near the center of the top edge of retention flap 200. A multiplicity of suitable attachment means may be used to connect support strap 235 to retention flap 200 and angled surface 205 such as, but not limited to, buttons, snaps, sewing, adhesive, hook and loop, elastic cord or buckles. In addition, battens 240 may be stitched into or otherwise attached to retention flap 200 which may help to hold the fabric of retention flap 200 upright when in the up position. Alternatively, segments of, a significant portion or the entire flap may be of a more rigid material such as a sheet plastic, sheet nylon, aluminum, firm webbing or fabric so to enable the flap to hold a relatively upright position when engaged.

In some embodiments, the retention flap may be designed to direct balls to a specific area or areas of the goal, for example, without limitation, to the center or to one or both sides of the goal, so that balls exit the goal at these locations or are retained at these locations. In such embodiments, there may be more than one retention flap or maybe it's a directional flap or a directing or guiding flap that run from the front of the device near each of the goal posts at an angle across the face of the device to a point at about one by tenth to about one fourth the distance up from the center of the goal and a front edge of the ball return device so that scored balls (i.e., balls that enter the goal) and land on the ball return device may roll down, may come in contact with the angled flap and may be directed by the retention flap to the side of the goal to which the retention flap may be angled. In one embodiment, the flaps may be attached to the ball return device such that they begin at about one by tenth to about one fourth the distance up from the front goal post sides of the device and angled toward the center of the goal, and may thus directing any scored ball towards the center of the goal. In another embodiment, one flap may be placed at an angle across the entire front edge of the ball return device so that scored balls may be directed to one side of the goal. Those skilled in the art will readily recognize, in light of and in accordance with the teachings of the present invention, that different types of goals may comprise different types of support structures and that various embodiments of the device may be configured to be attached to virtually any of these support structures. For example, without limitation, some goals may comprise base framing and/or rear supporting posts to which the ball return device may be attached. For example, the base framing (as described in Figures provided herein below) may include, but is not limited to, staked poles 420, 425, mechanical spring tension arm designed for the goal net 310, and framing provided for specific use of i.e., for attaching or fixing, the ball return device.

Figure 3:
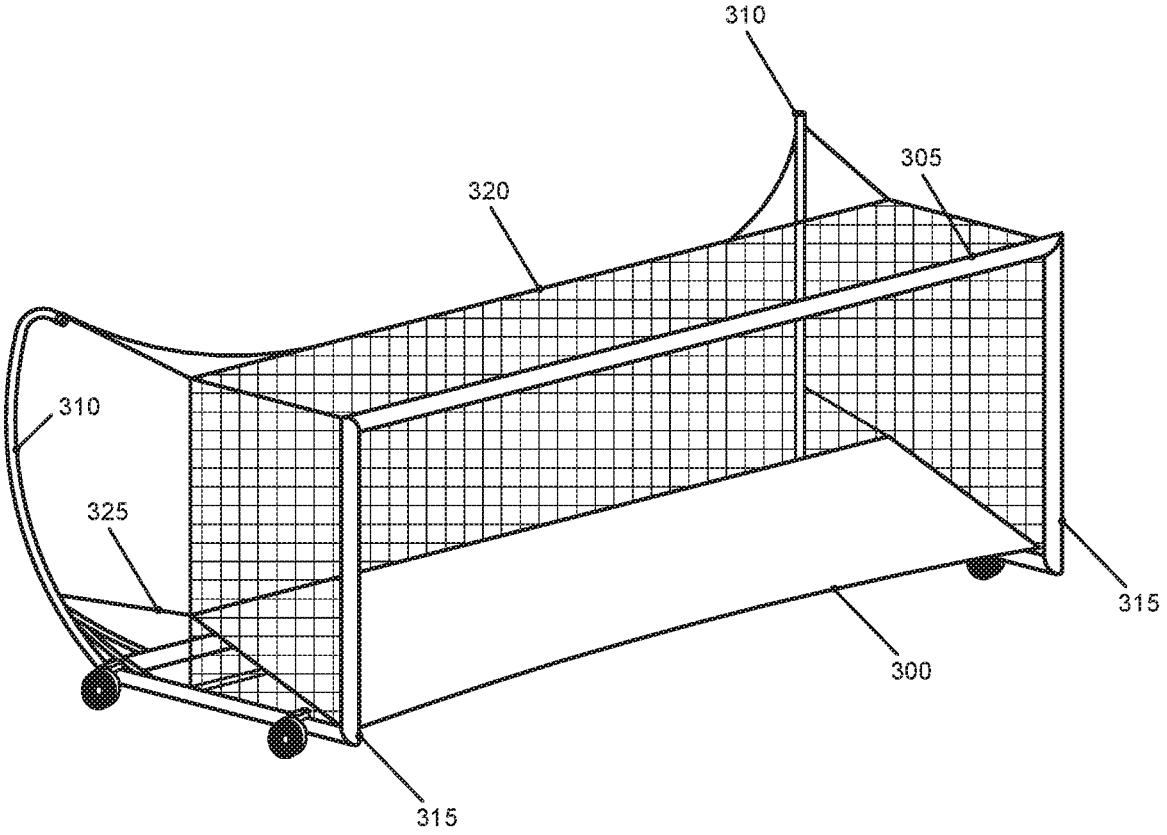
FIG. 3 is a front perspective view of a ball return device attached to a goal with external rear supporting posts, in accordance with an embodiment of the present invention.

In some embodiments, the front edge of the fabric of the ball return device may be staked tightly into the ground in addition to or instead of attached to the goal. FIGS. 3 through 5 show some non-limiting examples of different goals with attached ball return devices.

FIG. 3 is a front perspective view of a ball return device 300 attached to a goal 305 with external rear supporting posts 310, in accordance with an embodiment of the present invention. In the present embodiment, the two front corners of ball return device 300 may be connected to goal posts 315 goal support frame or ground stakes or ground screws, and the side edges and rear edge of ball return device 300 may be connected to a goal netting 320 to form the slope of ball return device 300 and to help prevent balls from fitting between ball return device 300 and netting 320. In addition, ball return device 300 comprises adjustable straps 325 that extend through the back of goal 305 and attach to rear supporting posts 310 to aid in giving ball return device 300 proper shape, slope and tension.

Figure 4A:
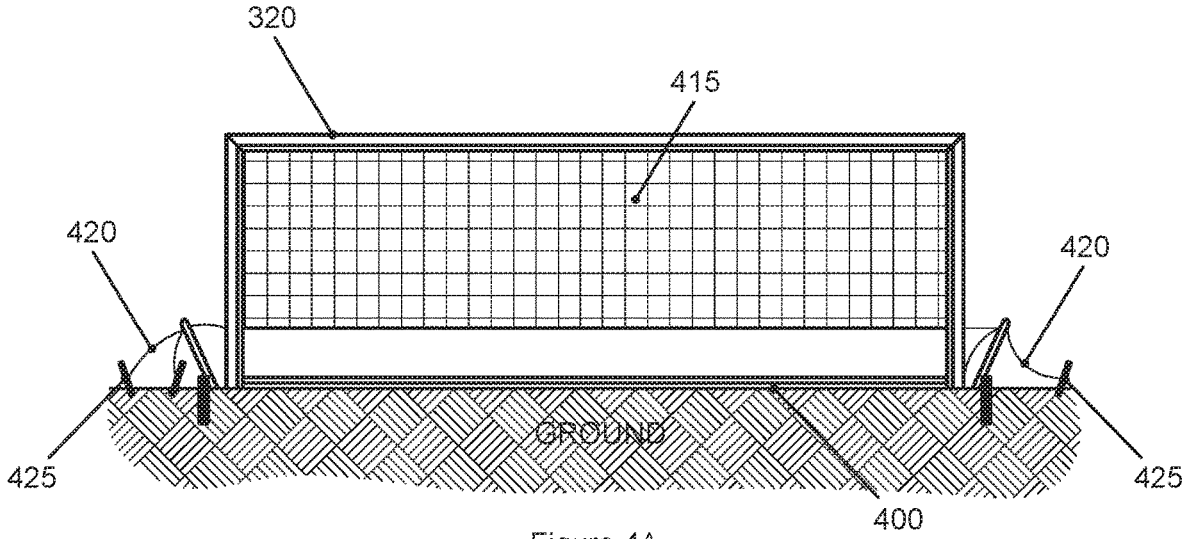
FIGS. 4A, 4B, 4C, and 4D illustrate a ball return device attached to various goals without rear supporting posts, in accordance with an embodiment of the present invention.
Figure 4B:
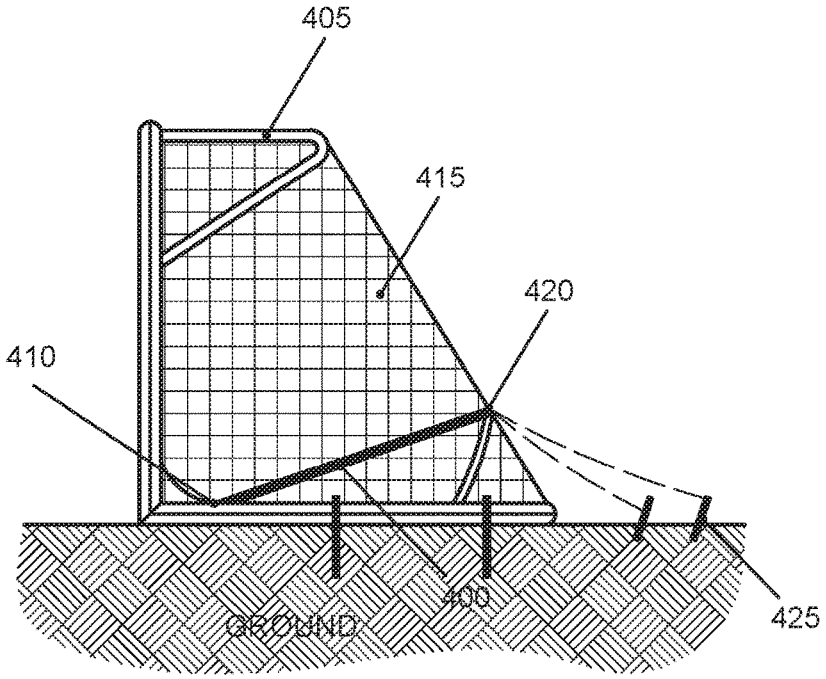
Figures 4C, 4D:
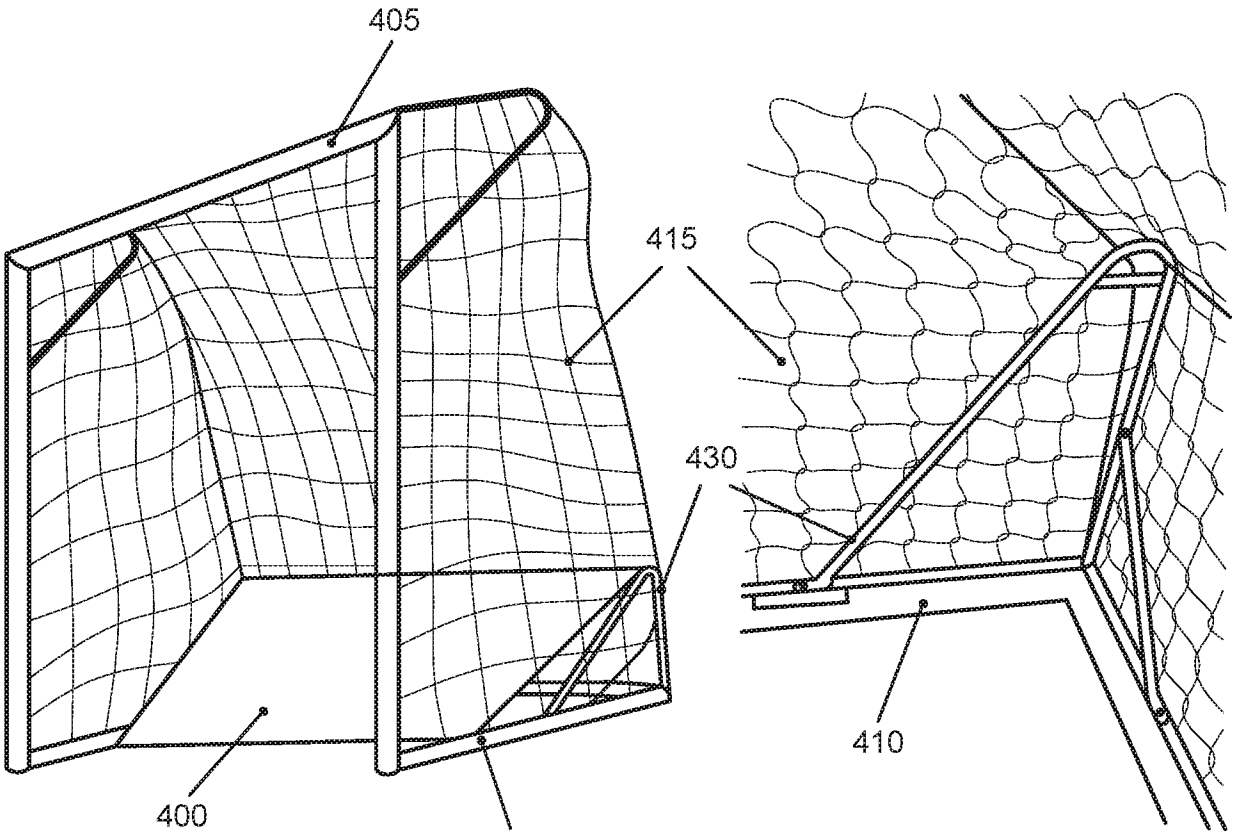
Figure 5:
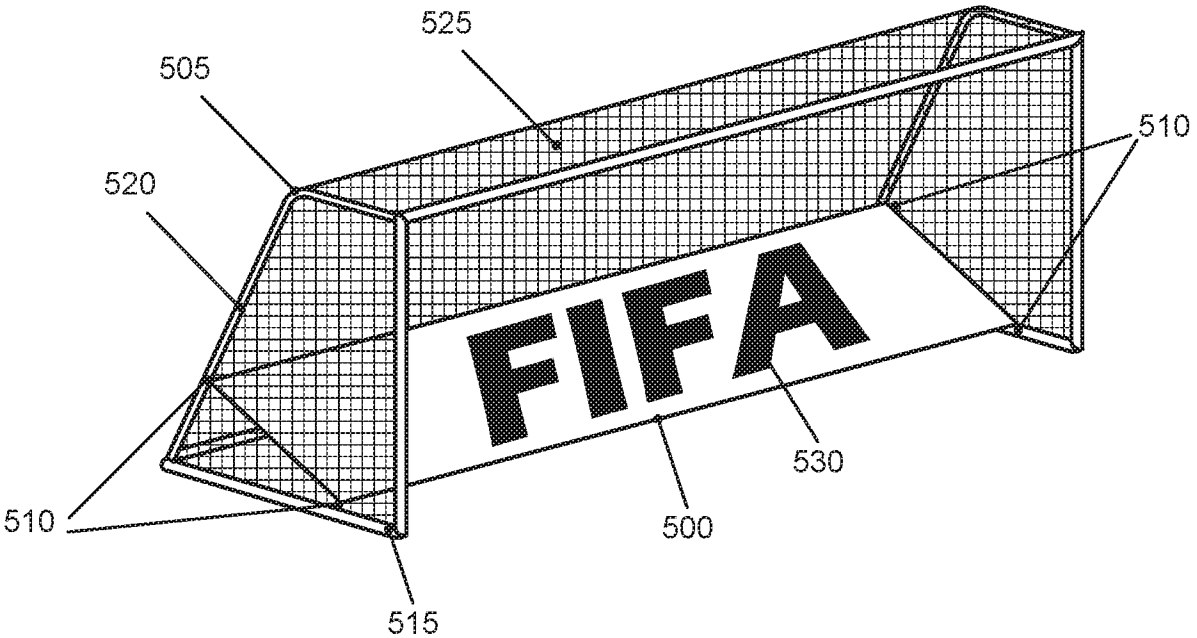
FIG. 5 is a front perspective view of a ball return device attached to a goal with a full support frame, in accordance with an embodiment of the present invention.

FIGS. 4A, 4B, 4C and 4D illustrate a ball return device 400 attached to a goal 405 types without rear vertical supporting frame, in accordance with an embodiment of the present invention. FIG. 4A is a diagrammatic front view, FIG. 4B is a diagrammatic side view, 4C is a diagrammatic front angled view and 4D is a diagrammatic bottom left rear goal view. In the present embodiment, the two front corners of ball return device 400 may be connected to a base frame 410, and the side edges and rear edge of ball return device 400 may be connected to a goal netting 415 to form the slope of ball return device 400 and to help prevent balls from fitting between ball return device 400 and netting 415. 4C and 4D show exemplary design of additional support framing 430 for the device which attaches, affixes, or integrates into existing portable soccer goal designs that provide proper support for the ball return device and maintain complete portability of the goal without having to remove or reset ground stakes or straps. Furthermore, ball return device 400 comprises additional ropes, lines or stanchions 420 extending through the back of goal 405 to stakes 425 in the ground to aid in giving ball return device 400 proper shape, slope, and tension. In some applications ropes, lines, or stanchions 420 may connect to other types of support structures rather than stakes in the ground such as, but not limited to, free standing weights, a mechanically weighted system, scoreboard posts, fences, or trees.

FIG. 5 is a front perspective view of a ball return device 500 attached to a goal 505 with a full support frame, in accordance with an embodiment of the present invention. In the present embodiment, in order to achieve a relatively tight stretch and fit, the corners of ball return device 500 or points on the goal frame may be fitted with webbing straps, rubber straps, speed adjusting/tightening buckles, bolts, clamps, zip type ties, ground stakes 510 or elastic cord with cleat adjustment connections to connect to a base fame 515 or ground and rear support posts 520. Adjustable straps and buckles 510 may enable an installer to pull the fabric of ball return device tight between the posts of the support frame of goal 505. The side and back edges of ball return device 500 may also be connected to a goal netting 525 to form the slope of ball return device 500 and help prevent balls from fitting between ball return device 500 and netting 525.

In addition to returning balls, ball return device 500 may also act as a surface for commercial marketing. It is believed that the large surface of ball return device 500 and its prominent location on the field of play when in use may provide an excellent platform for printed or projected marketing 530 of commercial brands, products, services, team or club names, sponsors, mascots, logos, trademarks, branding and the like. In some embodiments, the ball return device may also be constructed or fitted with electronic LED lighting for graphics or a flexible projection screen such as, but not limited to, an LCD screen to display marketing, replay video, or display other graphics or game statistics. The ball return device may also be fitted with electronic sensors, lighting, or a projection screen so to assist in the detecting, recording, notification, and display of goals scored, time remaining, and/or other relevant game statistics similar to a scoreboard display. During practice sessions, such displays may present targets for players to aim at when shooting balls.

Figure 6:
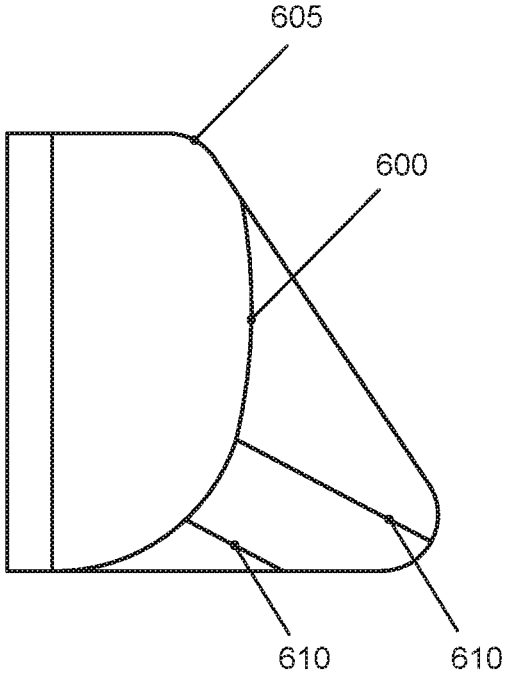
FIG. 6 is a diagrammatic side view of an exemplary ball return device, in accordance with an embodiment of the present invention.

FIG. 6 is a diagrammatic side view of an exemplary ball return device 600 that may also be used as a scoreboard, in accordance with an embodiment of the present invention. In the present embodiment, ball return device 600 may be attached to the rear of a goal netting 605 at a relatively high location to provide more surface area on which information may be displayed. One or more tension cords 610 may connect ball return device 600 to the ground, the goal frame, or other support structures to help maintain tautness in ball return device 600. Furthermore, ball return device 600 may be fitted with target areas, sensors and display means for shot speed, score keeping, score indicating, marketing, etc.

Figure 7A:
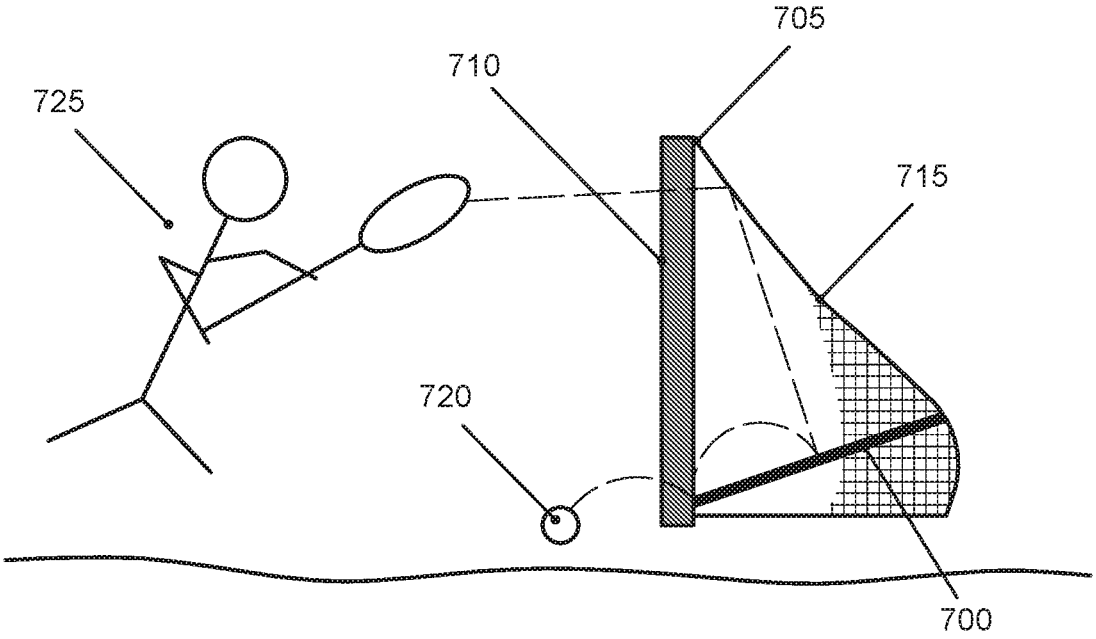
FIGS. 7A through 7C illustrate exemplary ball return devices attached to a lacrosse goal, in accordance with an embodiment of the present invention.
Figure 7B:
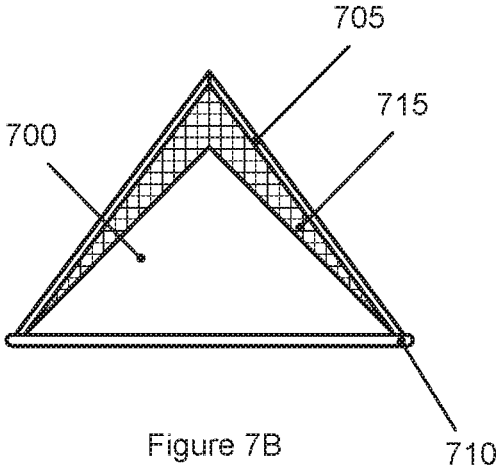
Figure 7C:
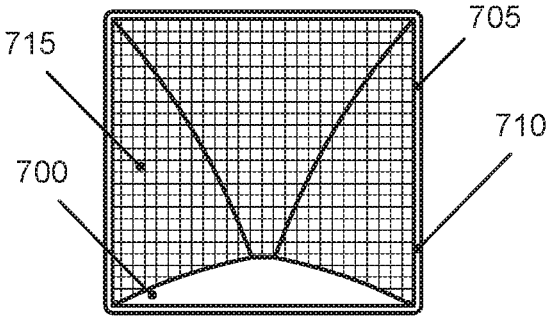

FIG. 7A through 7C illustrate an exemplary ball return device 700 attached to a lacrosse goal 705, in accordance with an embodiment of the present invention. FIG. 7A is a diagrammatic side view. FIG. 7B is a diagrammatic top view, and FIG. 7C is a diagrammatic front view. In the present embodiment, ball return device 700 comprises a triangular (or parallelogram) member of non-rigid material such as, but not limited to, fabric, netting, and plastic sheeting, the front edge of which may be attached to the bottom of each side goal post goal support frame 710 or ground stakes so that the fabric runs tightly along the ground between or behind posts 710. In addition, the side edges of ball return device 700 may be attached along the interior of a goal netting 715 in multiple locations so that ball return device 700 forms a continuous angled surface from the goal opening between posts 710 where ball return device 700 is at ground level to the rear of goal 705 where ball return device 700 is attached part of the way up netting 715. The attachment of ball return device 700 to netting 715 may also help prevent balls from fitting between ball return device 700 and netting 715 and becoming caught behind ball return device 700. These attachment points may or may not be adjustable, and may be similar to those illustrated by way of example in the foregoing embodiments. Additionally, some embodiments implemented for use with lacrosse goals may comprise optional features and accessories such as, but not limited to, target areas, retention flaps, tension cords, marketing displays, sensors, lights, and scoreboard like displays.

In typical use of the preset embodiment, when a ball 720 shot into goal 705, ball 720 may be stopped by goal netting 715 and/or ball return device 700. Then, ball 720 may drop or come to rest on the angled surface of ball return device 700 and roll by force of gravity towards the opening of goal 705 and out of goal 705. This may enable a player 725 or multiple players to continue playing or practicing with reduced interruptions as scored balls roll back out of goal 705 where players or coaches can quickly and easily retrieve them. Moreover, ball return device 700 typically does not hinder the normal flow, player performance, or rules of the game and may be used during an actual game.

In some embodiments of the present invention, ball return devices may comprise a relatively taut angled surface that provides a relatively firm plane on which balls may roll in combination with a connection between the angled surface and the goal netting that virtually integrates the angled surface into the goal netting. It is believed that this combination may typically ensures that balls do not become caught between or fall behind the angled surface and the loose netting and may efficiently roll down the angled surface towards the opening of the goal. In some embodiments, the ball return device may comprise a rigid frame to help maintain the tautness of the angled surface. In other embodiments, the ball return device may comprise a webbing or elastic cord perimeter pulled taught with adjustable buckles, ties or cleats to create the desired shape and firmness for the angled surface. Those skilled in the art will readily recognize, in light of and in accordance with the teachings of the present invention, that some embodiments may comprise a variety of other means for creating the desired shape and tautness of the angled surface including, without limitation, reinforcing poles, rods or strips, fabric interfacing, heavy stitching, and a combination of the means. In various embodiments, the attachment methods of the device or device support frame to goal posts, goal support frames, goal net supports or to the ground may include, but may not be limited to a variety of means, for example, Velcro®, elastic cord, stitched in fabric or netting, zip ties, rubber straps, clamps, bolts, cleats, ground stakes, ground screws, etc. In addition, the integrated attachment of the angled surface into the goal netting may also be achieved using a multiplicity of suitable means such as, but not limited to, hooks, lacing, self-adhesive hook and loop material, elastic cord and ties, plastic, nylon, or polypropylene cord or tubing, D-rings, grommets, fabric loops or a combination of means. FIGS. 8A through 13 illustrate some non-limiting examples of how the framing of the angled surface and the means of net mesh connection may be implemented.

Figure 8A:
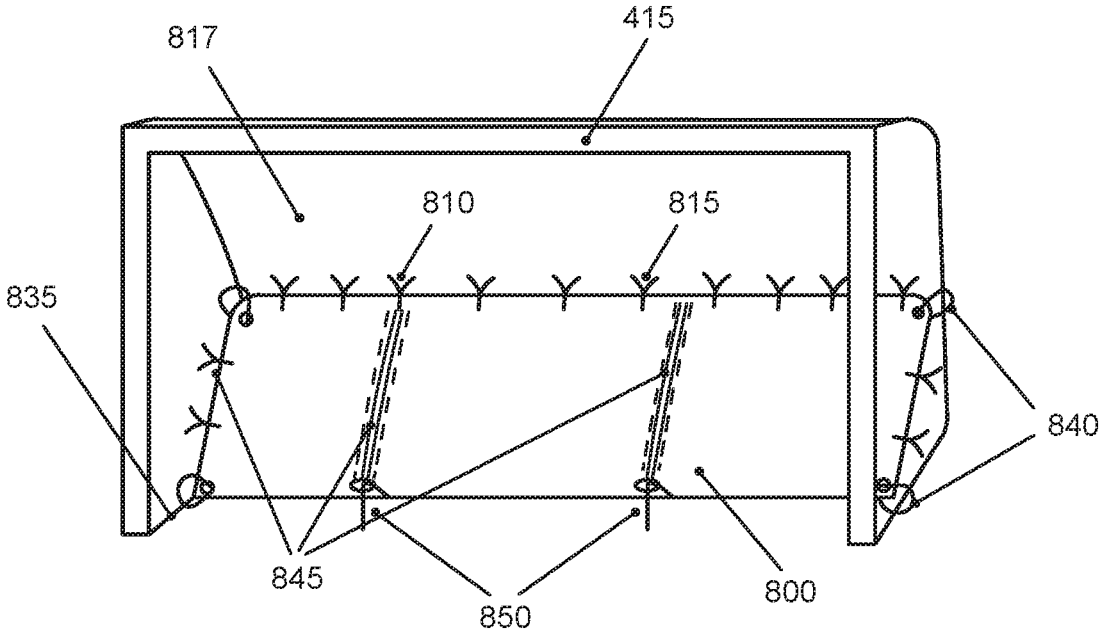
FIGS. 8A and 8B illustrate an exemplary attachment system for a ball return device to be connected to a goal netting, in accordance with an embodiment of the present invention.
Figure 8B:
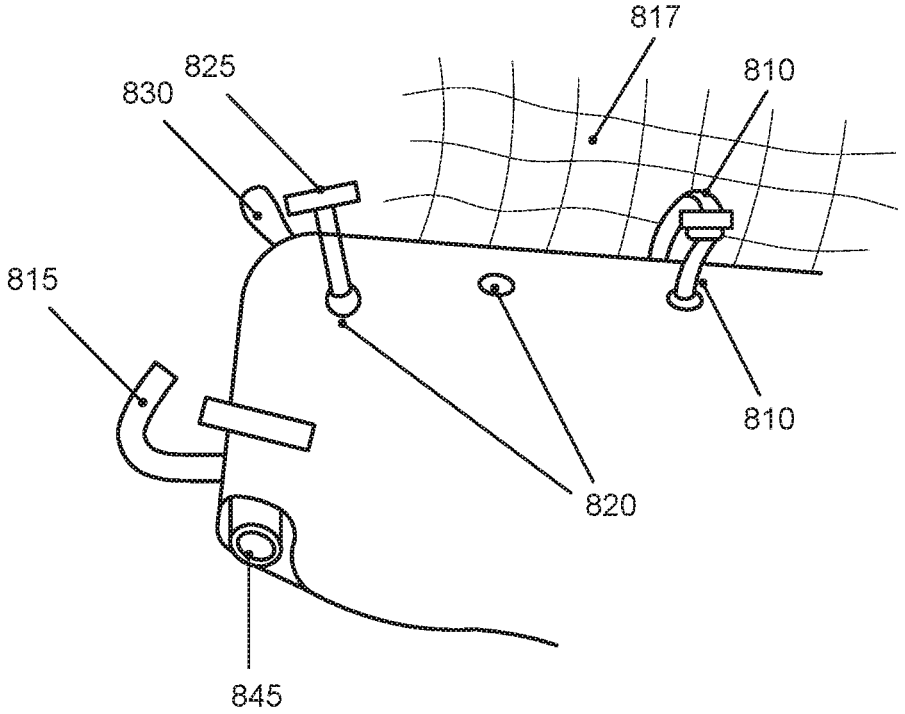

FIGS. 8A and 8B illustrate an exemplary attachment system for a ball return device 800 to be connected to a goal 805, in accordance with an embodiment of the present invention. FIG. 8A is a front perspective view, and FIG. 8B is a partially cut away top view of a rear corner of ball return device 800. In the present embodiment, the attachment system comprises a combination of elastic cord ties 810 and straps 815 made of a self-adhesive hook and loop material such as, but not limited to, Velcro® to attach ball return device 800 to a goal netting 817. In some applications ball return device 800 may be connected to goal netting 817 using all elastic cord ties 810 or all hook and loop straps 815. In the present embodiment, to connect ball return device 800 to netting 817, cord ties 810 and straps 815 are inserted into holes 820 in ball return device 800, wrapped around a piece of netting 817, and secured in place. Each strap 815 comprises one end covered in hook material and one end covered in loop material which may be pressed together to secure straps 815. To secure cord ties 810 a toggle 825 is inserted into a loop 830. In an exemplary embodiment, for a lacrosse goal, holes or connection points 820 may be placed in a range of from about one inch to about one and a half inches for a lacrosse goal ball return device. In an exemplary embodiment, for a soccer goal, holes/connection points 820 may be placed in a range of about t five to about ten inches for the soccer goal ball return device. It may be appreciated by a person with ordinary skill in the art, in light of and in accordance with the teachings of the present invention, that the spacing may be relevant to the size of the applicable sport's ball and spacing of the goal net string employed, i.e., typically to ensure that balls cannot fit/pass through the spaces between the attachment means. Ball return device 800 may be attached to a goal framework 835 using fixed or adjustable attachment means 840 such as, but not limited to, webbing straps with adjustable buckles, clamps, bolts, zip type ties, hook and loop (for example, Velcro®) straps, stitched in fabric or netting, rubber straps, rubber ties, and large elastic cord ties. Attachment means 840, cord ties 810, and straps 815 typically allow for easy and quick attachment, adjustment, or removal of ball return device 800 from goal 805. Some embodiments may be more permanently weaved into or onto the goal framework and netting so that the ball return devices have a more customized or permanent fit within the goal and goal netting design. In the present embodiment, ball return device 800 also comprises additional structural framing members 845 made of small tubes, flexible poles, or strips of rigid material integrated into the perimeter of ball return device 800 to help give ball return device 800 a more ideal shape and fit within the goal and its netting. Framing members 845 may be integrated into ball return device using various different means such as, but not limited to clips, clamps, brackets, bolts, a pocket, pockets, or sleeves formed in ball return device 800, sewing, zip ties, or adhesive. Furthermore, the front edge of ball return device 800 may optionally be secured to the ground with stakes or ground screws 850.

Figure 9A:
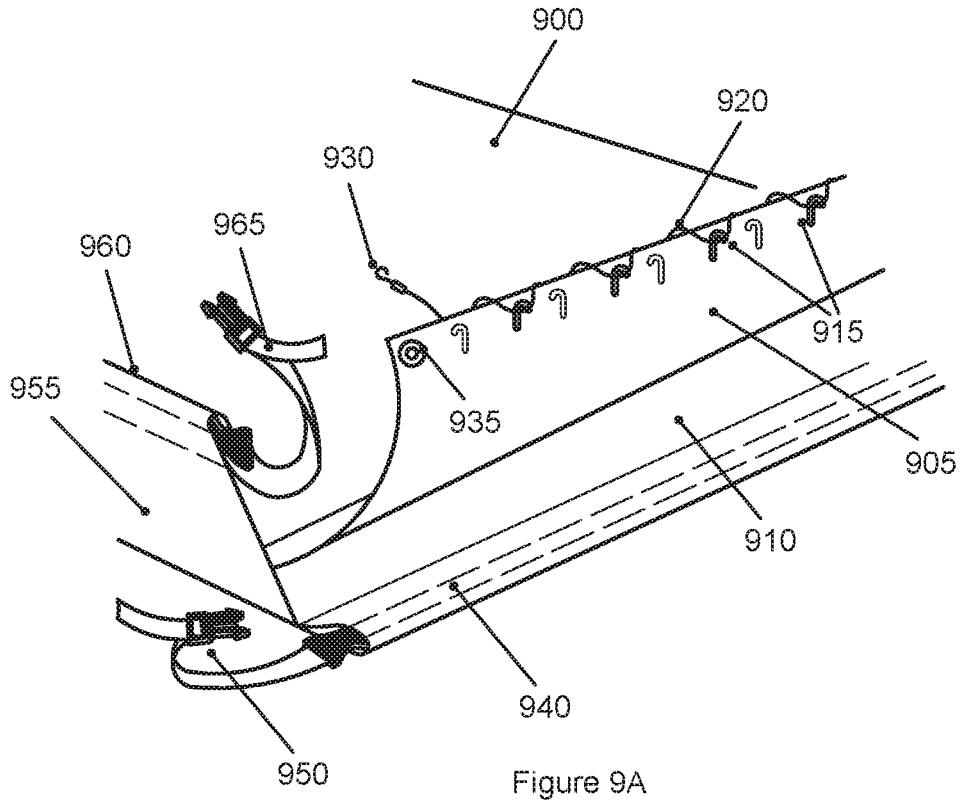
FIGS. 9A and 9B illustrate an exemplary attachment system for a ball return device, in accordance with an embodiment of the present invention.
Figure 9B:
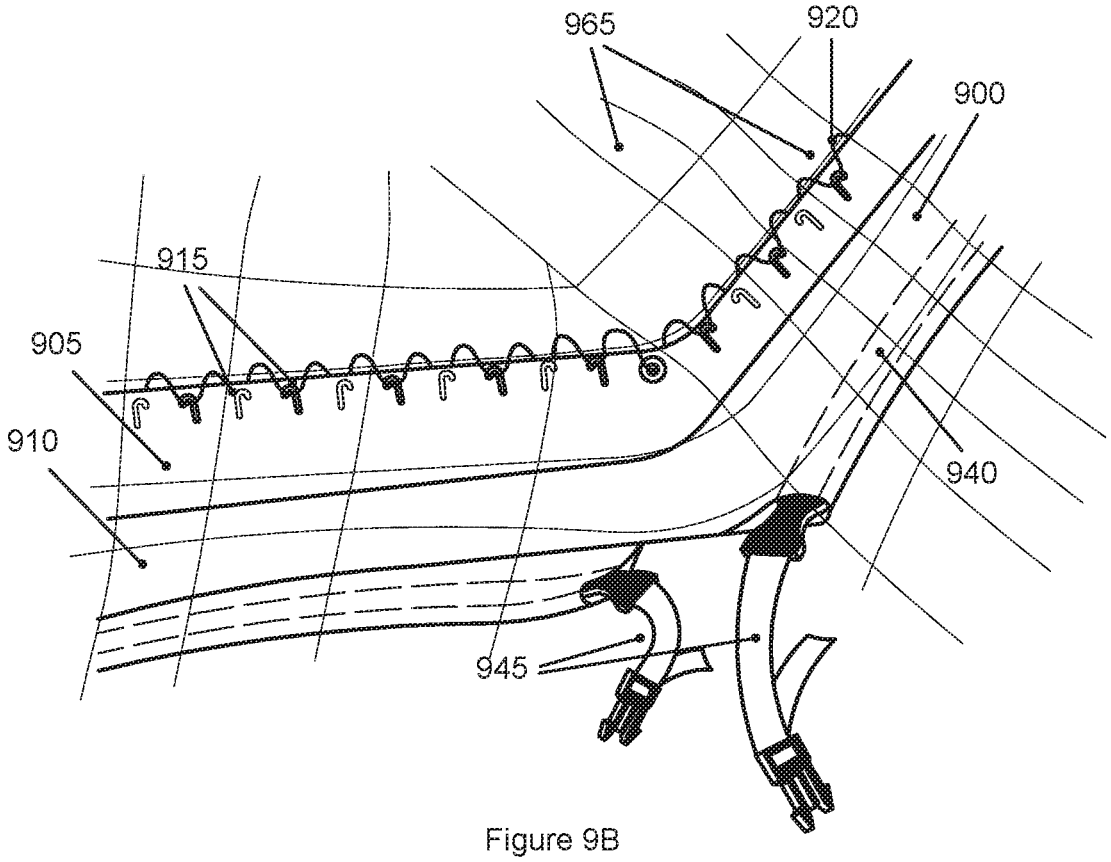

FIGS. 9A and 9B illustrate an exemplary attachment system for a ball return device 900, in accordance with an embodiment of the present invention. FIG. 9A is a side perspective view of a front corner of ball return device 900, and FIG. 9B is a rear perspective view of a rear edge of ball return device 900. In the present embodiment, the attachment system comprises a net integration flap 905 that extends upward from a taut angled surface 910. Net integration flap 905 extends around the sides and rear edge of ball return device 900 and comprises lacing hooks 915 along a top edge. Lacing hooks 915 are placed on alternating sides of net integration flap 905 so that every other hook 915 is on the net side of net integration flap 905 and the remaining hooks 915 are on the inside of net integration flap 905. In some implementations, hooks 915 may all be located on the net side of net integration flap 905 or all on the inside of net integration flap 905. A lacing cord 920, which may be made of elastic cord, standard nylon string, plastic cord or flexible tubing, etc., is laced around hooks 915 and a goal netting 925. Lacing cord 920 may also be laced around poles, goal framework, or other support structures. Referring to FIG. 9A, each end of lacing cord 920 comprises a hook 930 that may be attached to grommets 935 in net integration flap 905 near the front edge of ball return device 900 to help prevent lacing cord 920 from becoming unlaced. It is contemplated that various alternate means for securing the ends of lacing cord 920 to net integration flap 905 may be used including, but not limited to, knots, rings or loops on net integration flap 905 to which hook 930 may be attached, clamps, clips, and buckles. In addition, rings or fabric loops may be used on net integration flap 905 as the connection points for lacing cord 920 in place of hooks 915. Furthermore, some embodiments may be implemented without a net integration flap, and such connection points may be located directly on the taut angled surface of the ball return device. In the present embodiment, angled surface 910 comprises a taut webbing perimeter frame 940 to help create the desired shape and firmness for angled surface 910. Referring to FIG. 9B, at rear corners of perimeter frame 940 along the rear corners of ball return device 900 connected by fixed or adjustable straps and buckles 945 may enable perimeter frame 940 to wrap around or affix to a rear goal support via bolt, clamp, strap, etc. Referring to FIG. 9A fixed or adjustable straps and buckles 950 at the front edge of angled surface 910 may enable perimeter frame 940 to be attached to front goal posts or adjacent lower goal support frame. In the present embodiment, a retention flap 955 is shown with a webbing edge 965 having a width of about one inch, comprising an adjustable strap and a buckle 965 at each end. Adjustable straps and buckles 965 may be tightened around or affixed to goal posts goal frame or ground stake to pull webbing edge 965 taut and hold retention flap 960 in place. In certain embodiments, the device may only have a left and a right side device support/tension framing, in certain embodiments, only a front and a rear support, in certain embodiments, only a rear support, in certain embodiments, a side and a rear support, and in certain embodiments, nearly no support other than that provided by the goal netting, net frame, goal frame, or goal supporting frame.

Figure 10A:
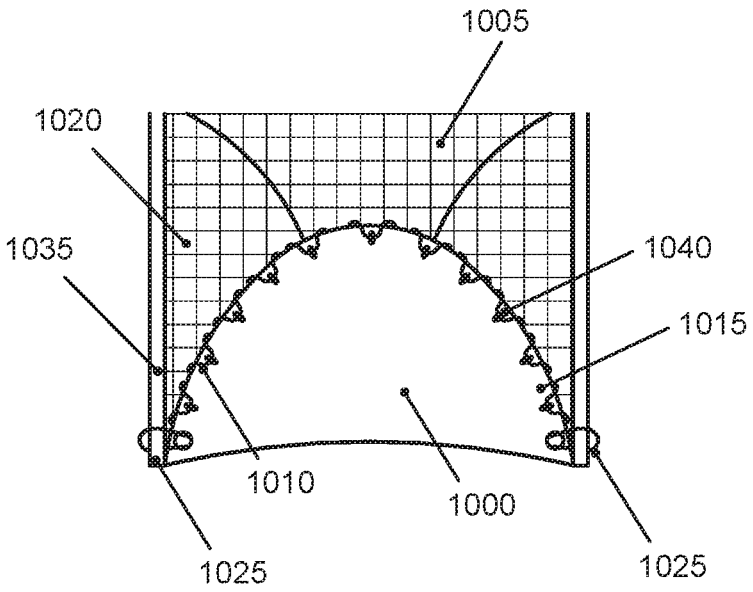
FIGS. 10A and 10B illustrate an exemplary attachment system for a ball return device, in accordance with an embodiment of the present invention.
Figure 10B:
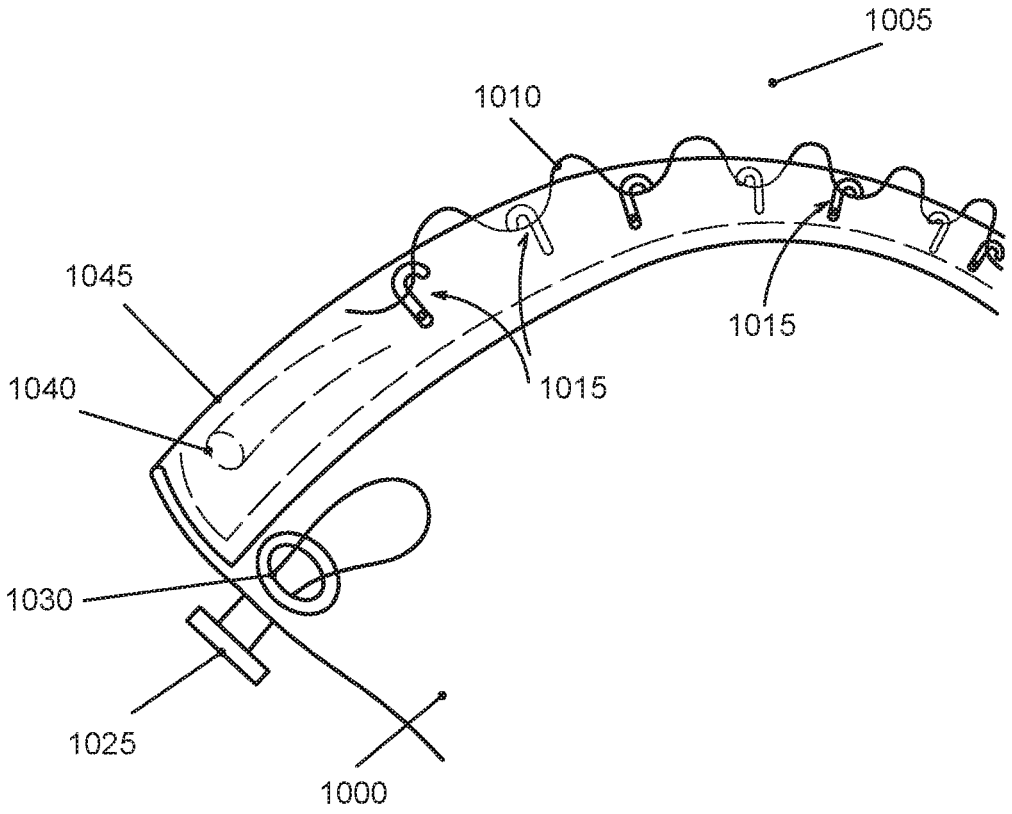

FIGS. 10A and 10B illustrate an exemplary attachment system for a ball return device 1000, in accordance with an embodiment of the present invention. FIG. 10A is a diagrammatic front view of ball return device 1000 attached to a goal 1005, and FIG. 10B is a partially transparent top view of a front corner of ball return device 1000. In the present embodiment, the attachment system comprises a lacing cord 1010 that may be laced around hooks 1015 fixed to the perimeter of ball return device 1000 and around a goal netting 1020, poles, or goal framework. This attachment system is similar to the attachment system illustrated by way of example in FIGS. 9A and 9B without a net integration flap. Elastic cord ties 1025 may be inserted into grommets 1030, holes, or loops on each side of the front edge of ball return device 1000 to attach ball return device 1000 to front goal posts 1035. Ball return device 1000 may also comprise structural framing members 1040 inserted into a pocket 1045 around the perimeter of ball return device 10000 to help give ball return device 1000 a more ideal shape and fit within goal 1005. Framing members 1040 may be a flexible or rigid rod, pipe, pole, strip, etc. and may be made of various different materials such as, but not limited to, plastic, fiberglass, spring steel, or aluminum.

Figure 11A:
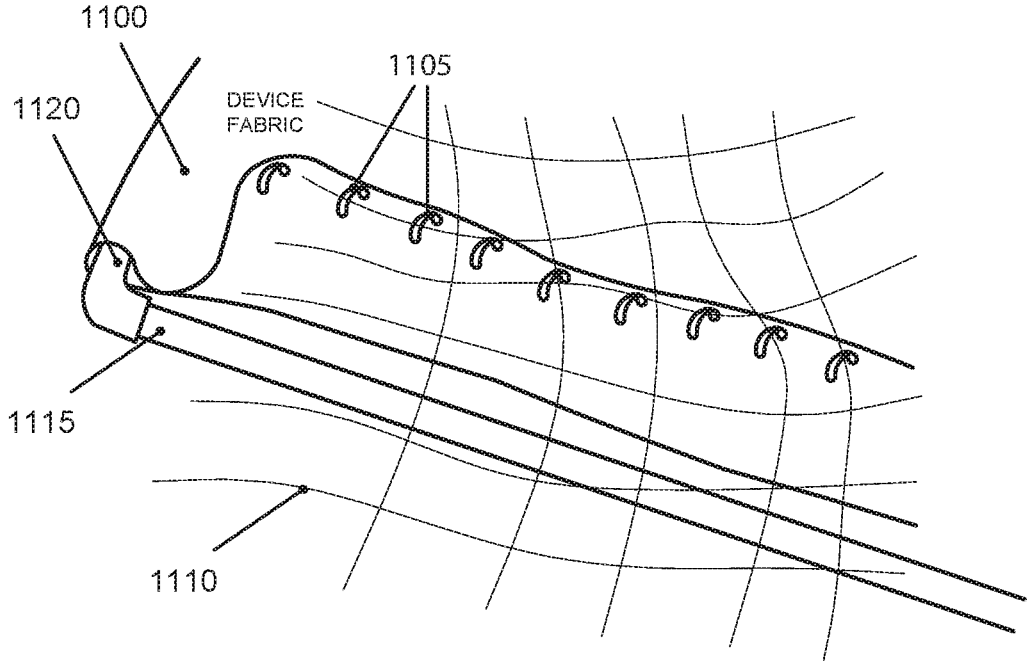
FIGS. 11A, 11B, 11C, 11D, 11E, 11F, 11G, 11Ia and 11Ib illustrate exemplary attachment systems for a ball return device, other net devices or nets to frames, in accordance with an embodiment of the present invention.
Figure 11B:
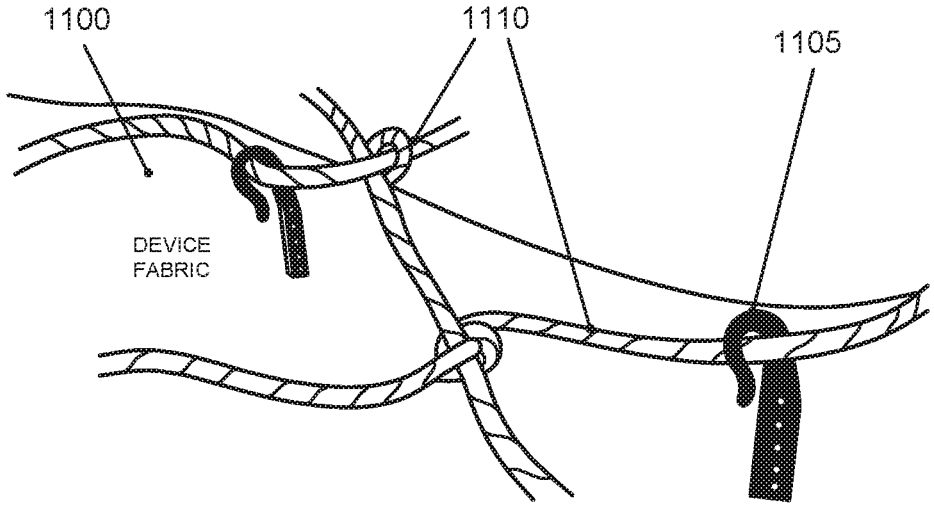
Figure 11C:
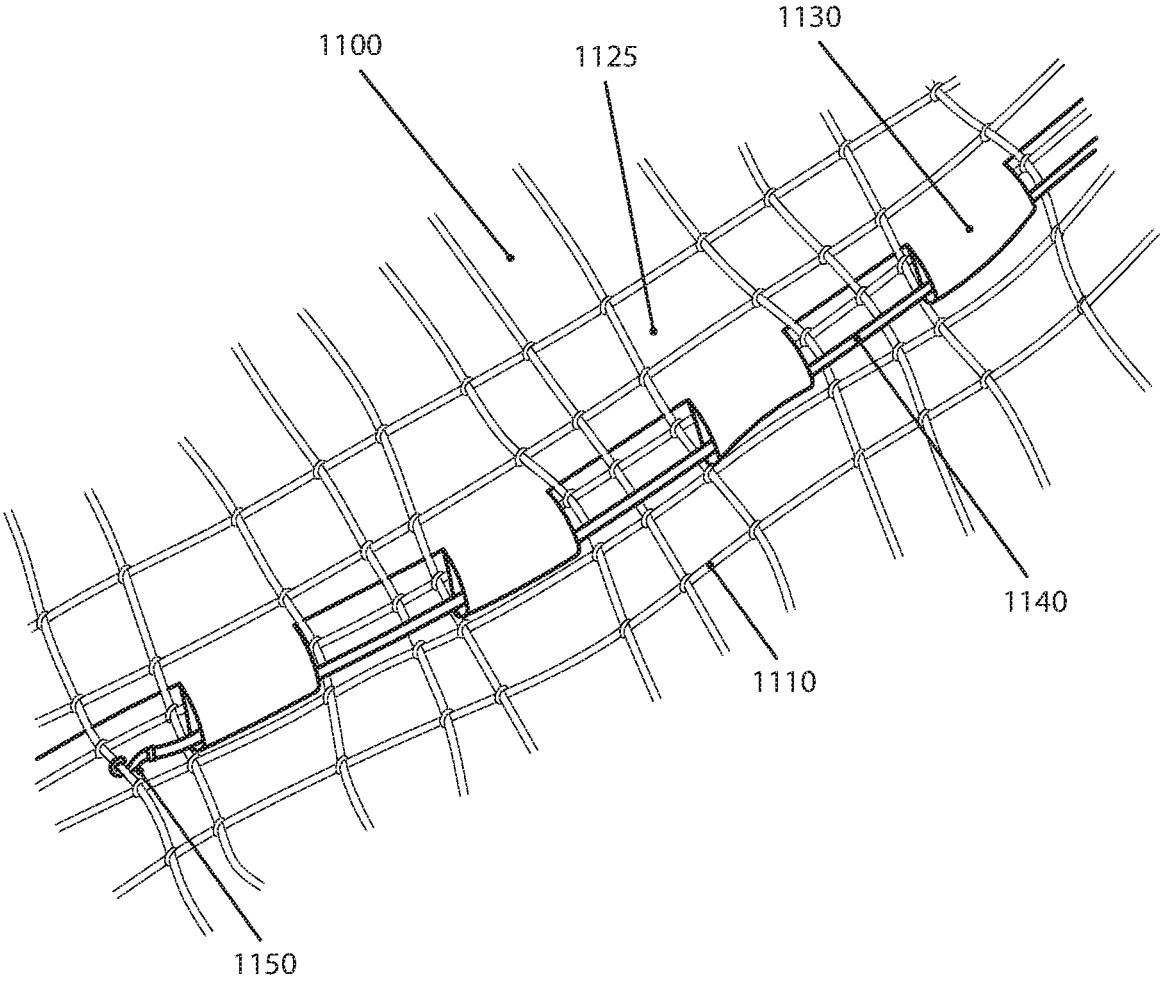
Figure 11D:
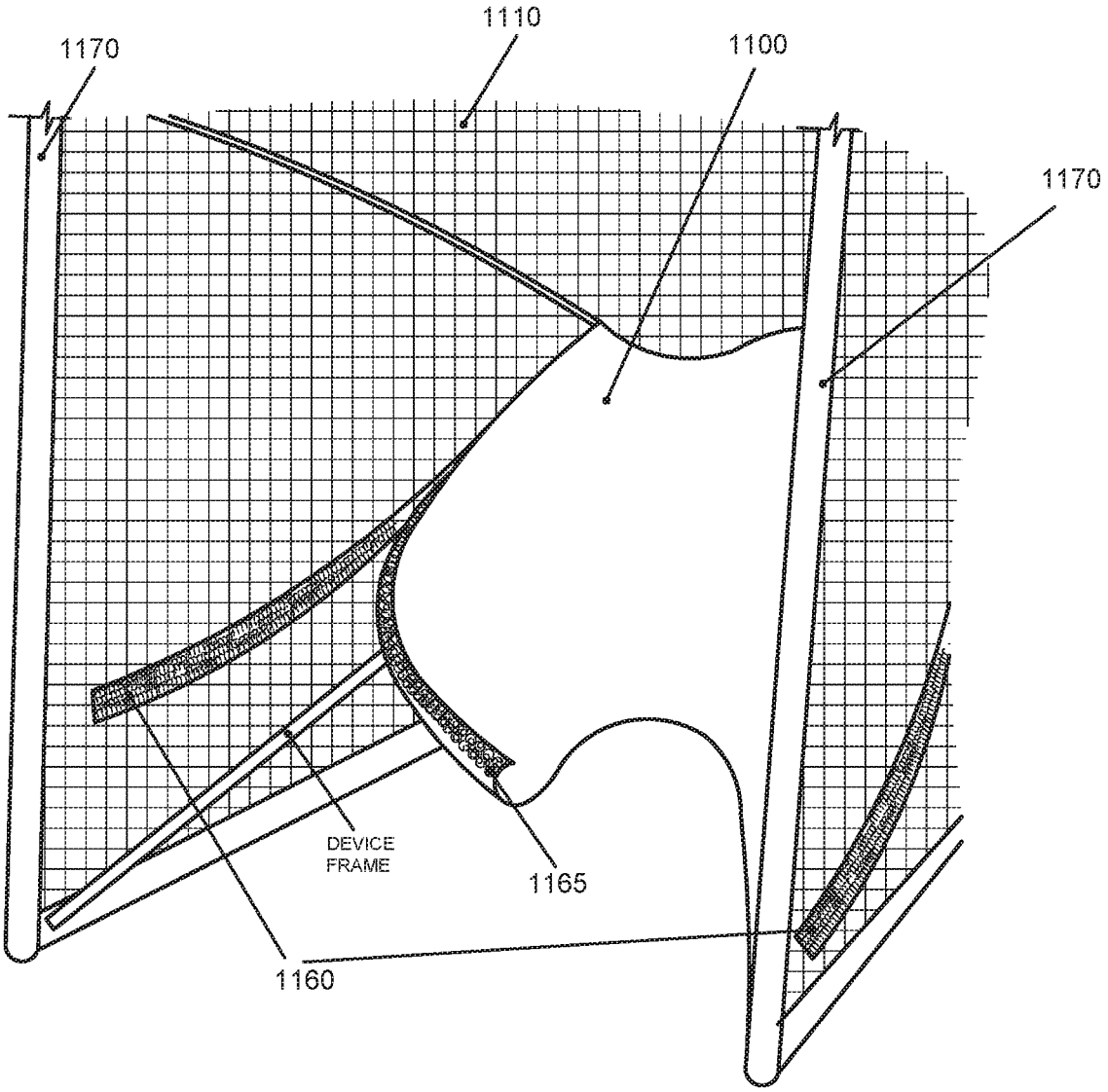

FIGS. 11A, 11B, 11C, and 11D illustrate an exemplary attachment system for a ball return device 1100, in accordance with an embodiment of the present invention. FIG. 11A is a side perspective view of a rear corner of ball return device 1100. FIG. 11B is a side perspective close up view of attachment hooks 1105, FIG. 11C is a perspective view of a ball return device net attachment, and FIG. 11D is a perspective view of a ball return device to goal netting of a lacrosse goal post.

In the present embodiment, hooks 1105 attached into the fabric of ball return device 1100 clip directly onto a goal netting 1110. It is believed that clipping hooks 1105 directly to netting 1110 may speed up the installation and removal ball return device 1100 in comparison to devices with attachment means using lacing without significant negative performance effects. It is contemplated that hooks 1105 may be made of a multiplicity of suitable materials such as, but not limited to, various plastics or metals, and hooks 1105 of different sizes may be provided for different types of netting 1110 that may use string of varying sizes. Referring to FIG. 11A, ball return device 1100 also comprises structural framing members 1115 made of plastic or metal pipe that may be inserted into a pocket 1120 or affixed along one or more of the edges of ball return device 1100.

FIG. 11C illustrates a ball return device net attachment where a plurality of closed loops of fabric or webbing 1130 same or less than the width to the holes/openings in the goal mesh net with total loop material length of preferably 1½ inch able to pull through net holes/openings 1110 are located around the perimeter of the device. Spacing of the loops is such that the ball/puck cannot pass between the net and device. Loops 1130 may be adjacent each other or be spaced apart by some distance. The loops 1130 are fed through the goal net 1110 openings 1125 in appropriate locations along interior of net 1110 surface to create optimal shape of device. Not all loops 1130 need to be fed through the net mesh or have lacing cord 1140 pass through the loops during installation. Only enough closed loops needed to secure device 1100 to net 1110 so that balls cannot go through the connection are required. One with ordinary skill in the art could recognize that the noted fabric closed loops 1130 could be substituted with other materials such as netting similar to that used for the (a) goal net 1110 as in this exemplary image could have net segments pulled through the goal netting in a similar fashion. The device 1100 is then secured in place by inserting smooth vinyl tubing, cord, cable or string of lacing cord 1140 in through the loops 1130 on the outside of the goal net as to entrap the net 1110 between the device 1120 on the inside of the goal and the lacing cord 1140 on the outside of the goal net. Lacing cord 1140 is preferably an elastomeric cord. Lacing cord 1140 is preferably a tube or cord with optional connectors 1195 (tube connectors or cord connectors) to extend the length of the lacing cord. Lacing cord 1140 is preferably ¼ inch diameter material. Lacing cord 1140 is preferably PVC, vinyl, polyethylene or silicon having elongation to break greater than 900%, tensile strength greater than 1348 PSI, a hardness less than Shore A 50. The smooth, semi rigid tubing or cord provides for quick and simple threading of tube/lacing through the loop material. A small hook 1150 at the ends of tubing may be clipped around goal net 1110 as to hold the tubing in place though hooks may not be required, or the ends of the tubing/cord could be joined using a coupling device 1160 designed for the purpose. When the ball return device 1100 is to be removed from the goal, the hooks 1150 may be detached from net 1110 or uncoupled and the lacing tubing 1140 can be pulled from one end to very quickly slide the tubing out from the device loops to detaching the device from the goal and goal netting. In an exemplary embodiment, it may be appreciated by a person with ordinary skill in the art, in light of and in accordance with the teachings of the present invention, that this method of device to net attachment may provide the fastest installation and removal of the ball return device to/from the goal net.

FIG. 11D of an exemplary attachment system for ball return device to goal netting connected to a lacrosse goal frame 1170. The attachment system comprises one side Velcro® strip (hook side strip) 1165 sewed to the perimeter of the ball return device fabric 1100. The opposing Velcro® strip (loop side strip) 1160 is located on the outside of the goal netting 1110. The net is then "sandwiched" between the two sections of Velcro® strip, securing the ball return device in the proper position on the net as too provide ideal shape and fit and slope of the ball return device.

FIGS. 11E, 11F, 11G, 11H, 11Ia and 11Ib illustrate exemplary attachment systems for attaching net mesh 1110 to frame 1170, in accordance with an embodiment of the present invention. These same attachment systems may be used to attach ball return device 1100 or other accessories attached to the inside or outside of a sports goal, such as backstop netting, net weights, targets, training tools, barriers, sensors, measuring devices, marketing implements, etc.

Figure 11E:
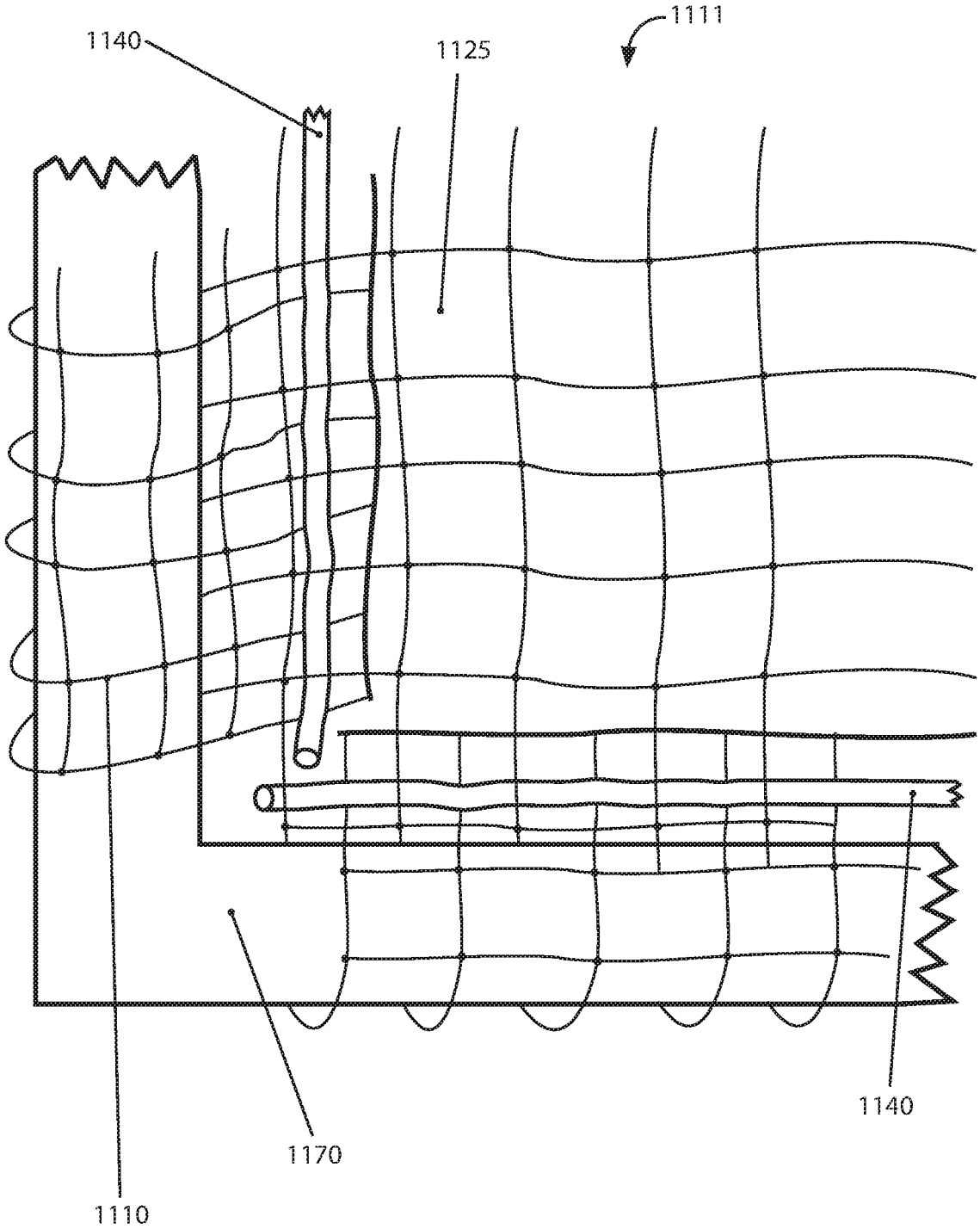
Figure 11F:
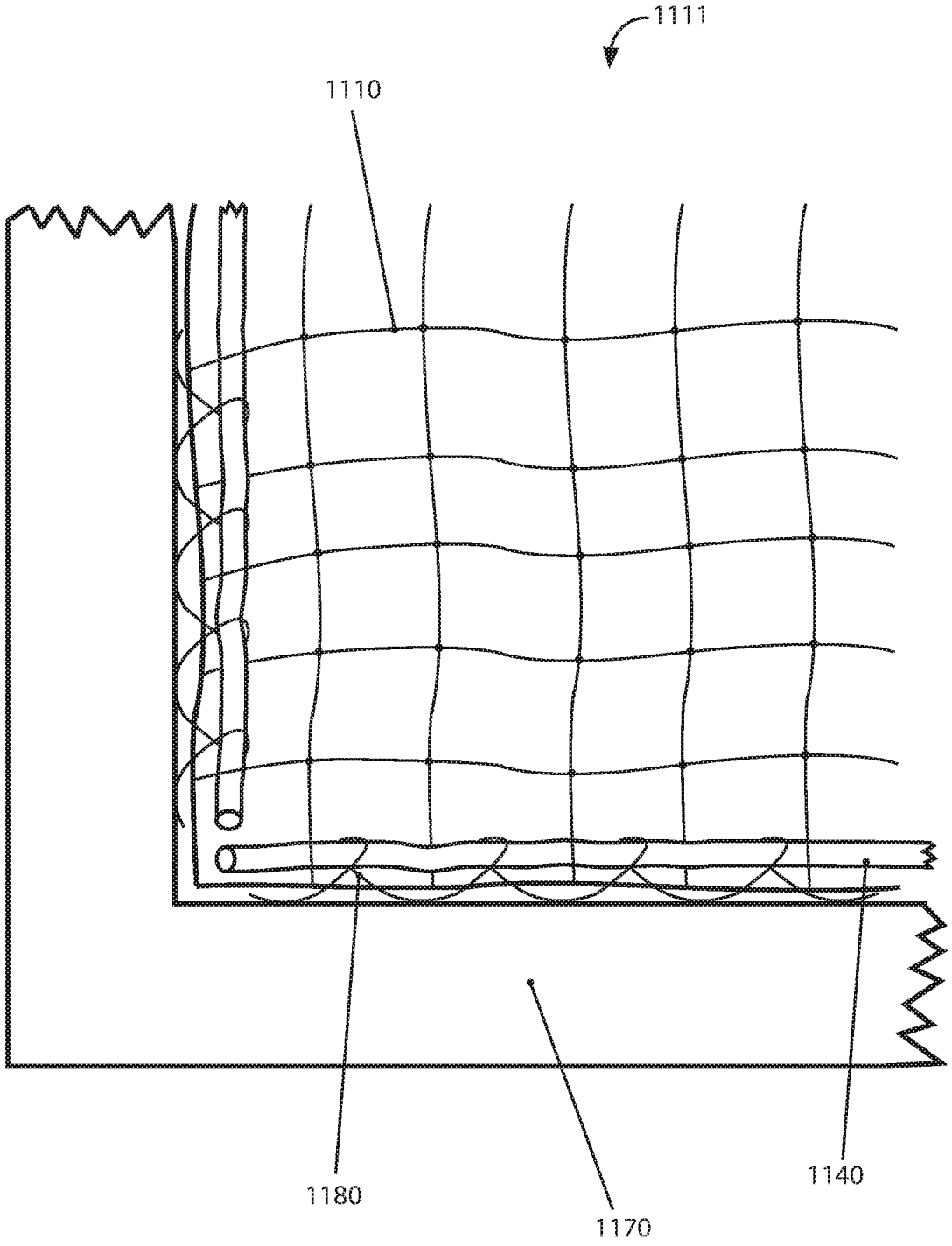
Figure 11G:
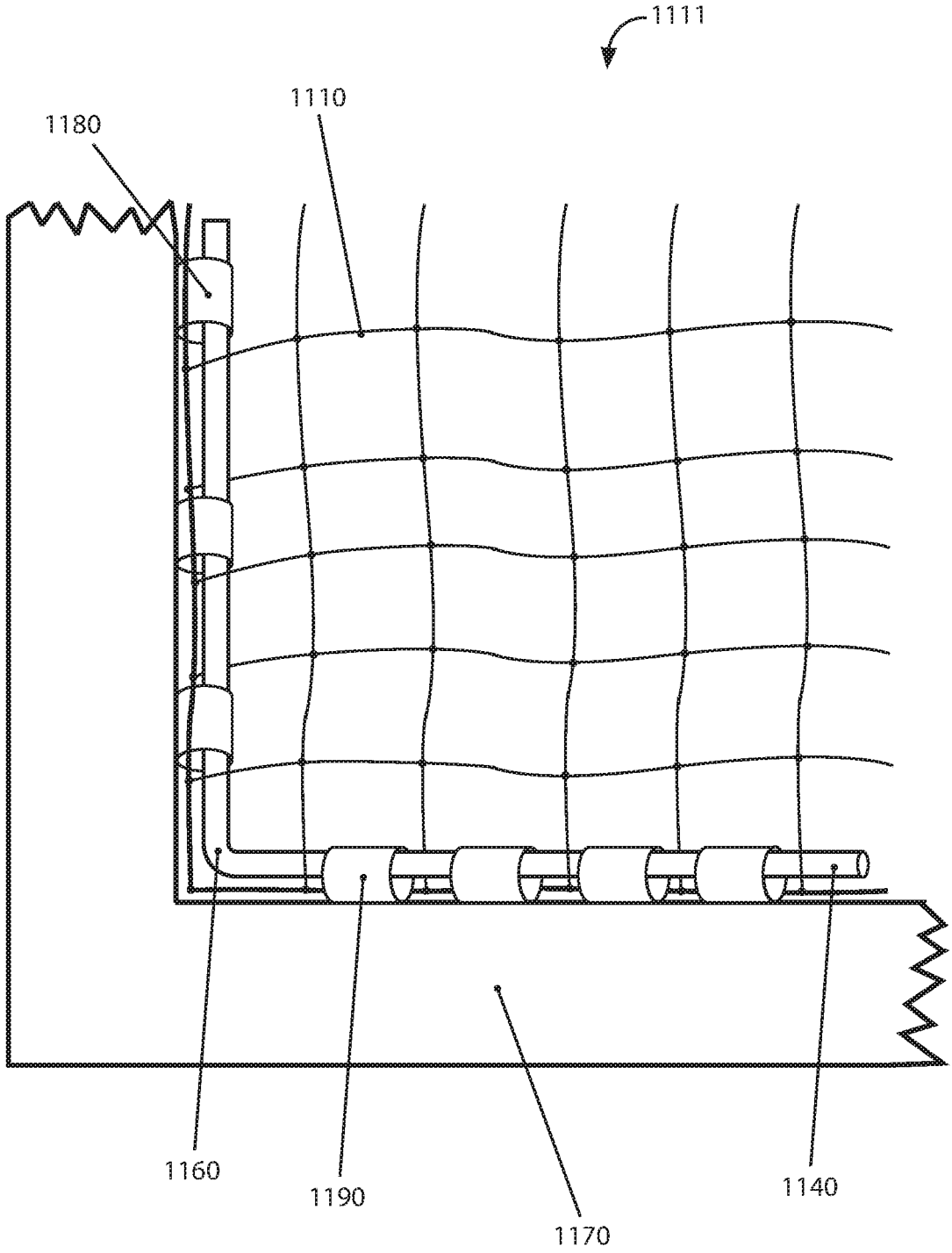
Figure 11H:
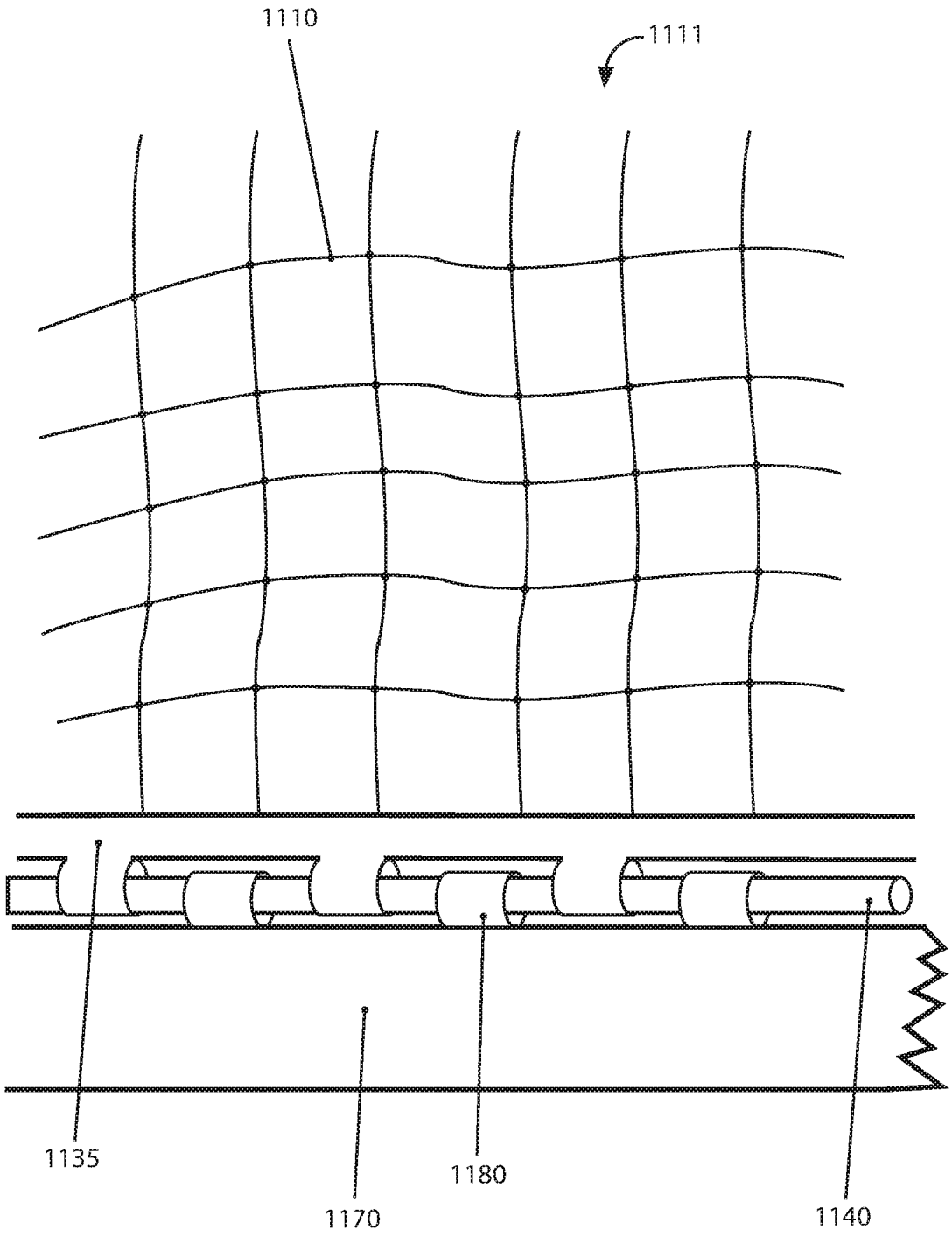
FIG. 11H is a perspective view of a net to frame attachment, FIG. 11Ia is a side perspective view of a net to frame attachment, and FIG. 11Ib is an enlarged view of the circled area labeled 11Ib in FIG. 11Ia.

FIG. 11E is one embodiment of net to frame attachment system 1111 where net mesh 1110 is wrapped around goal frame 1170 and a lacing cord 1140 passed through net mesh openings 1125.

FIGS. 11F, 11G, 11H, 11Ia, and 1Ib where the net side of the goal frame 1170 is outfitted with net fastening elements such as frame loops 1190, hooks 1185, wire coils 1180 attached periodically to the frame, or rings 1180 of metal tubing or wire, plastic or similar material. Loops, holes, rings may also be designed into and molded or cast directly into or the goal frame specifically in order to receive the lacing cord/tubing for this net connection method. The loops, rings, wire coils will be sized so that tubing, cord, metal rod, solid or collapsible fiberglass rod, cable or string 1140 can pass through described loops or rings 1180, through a segment of netting 1110 or fabric loop sewn into goal netting 1135, back through a ring 1180 and so on. Such rings or loops may be permanently affixed to the goal frame with welds, clipped into frame slots, or holes, bolted or retrofitted to post production goals using self-taping type screws, plastic zip tie type straps or adhered with durable adhesives such as epoxy or strong adhesive glues. Spacing of frame loops or rings would he relative to the size of the goal and to the ball/puck used in that sport so that the ball/puck could not pass through the gap between the goal netting and goal frame but typically between 1.5 inches and 8 inches between loops/rings. This system 1111 of net to goal connecting increases speed of the net installation/attachment and detachment like no other present day method of goal to net connection.

Figure 11I:
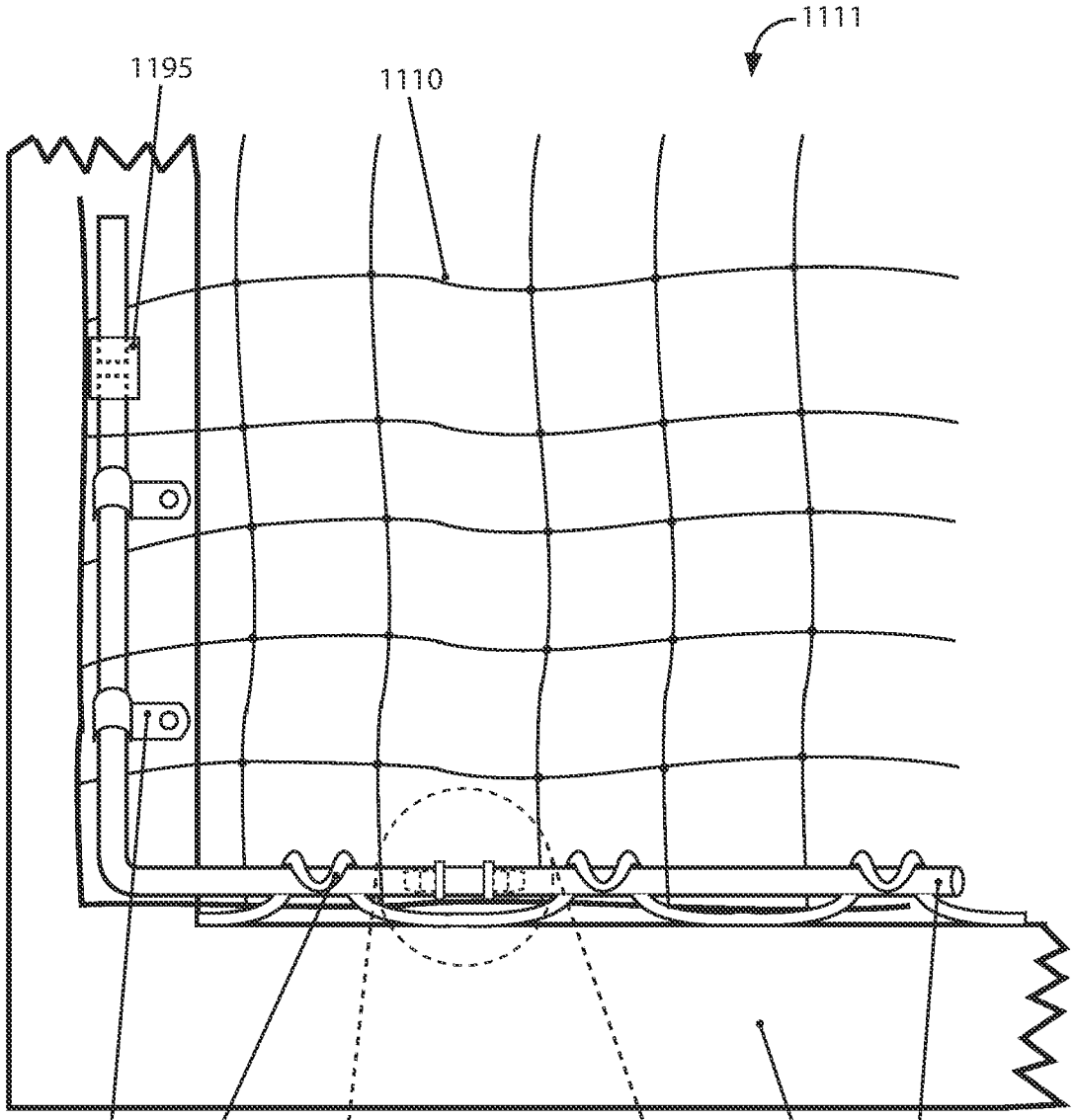
Figure 11I:
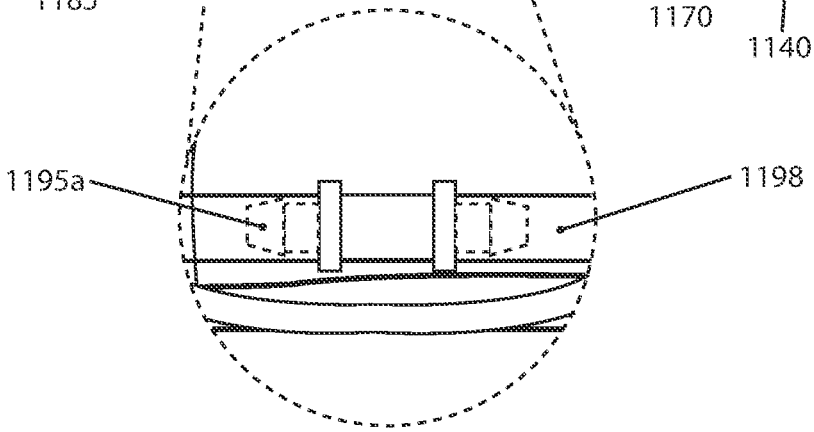

This sports net lacing system 1111 often only takes seconds for removal of the tubing lacing and complete detachment of the goal net. What makes tubing best is its smooth, semi ridged yet flexible properties. This type of tubing makes for easy installation, fast removal, shock absorption, strength, light weight, no need for tying or knots (because being semi ridged it returns to original position unlike string, and it can be connected to itself with push fittings) no bulky clamps like cable or monofilament typically needs, compacts well, and is light weight, unlike metal rods. The smooth tubing slips through the frame loops and net/net loops relative to lacing string which must be warped around the net and frame, laced in or tied many times using considerable time. The smooth lacing cord/tubing is non-abrasive, has better UV light protection than string, line, bungee cord, or hook and loop type fasteners used currently giving it greater durability and longer useable life. Its strong consistent connection points to the goal enable gap free connection. The properties and smooth surface of the tubing/cord provide for excellent shock absorption and low abrasion for the goal net so to extend the life of the net and the tubing/cord outlasts the life of current methods due to its superior weather resistance. The semi ridged properties of the tubing/cord enables it to stay in place without its ends being tied like commonly used string which needs to be tight and its ends tied off. Otherwise string can pull loose creating poor fitting nets. The tubing can also be secured using small clips or clamps attached to the ends which clip to points on the net or goal. Alternatively, the ends can be secured with connectors to other tubing or cord segments of the same or different diameter used in the net to goal attachment creating one longer piece of multiple sections or one continuous loop around the back side perimeter of the goal. FIG. 11Ib illustrates how interior connectors 1195*a* can be placed within hollow core 1198 of lacing tube 1140 to extend the length of the lacing tube. Additionally, different tubing sections with different properties may be combined within the same goal system such that some net connection areas may benefit from a more elastic connection while others a more static connection. This net to goal frame attachment system is beneficial to all sports goals involving nets including but not limited to soccer, lacrosse, basketball, field hockey, hockey, handball, etc.

Figure 12:
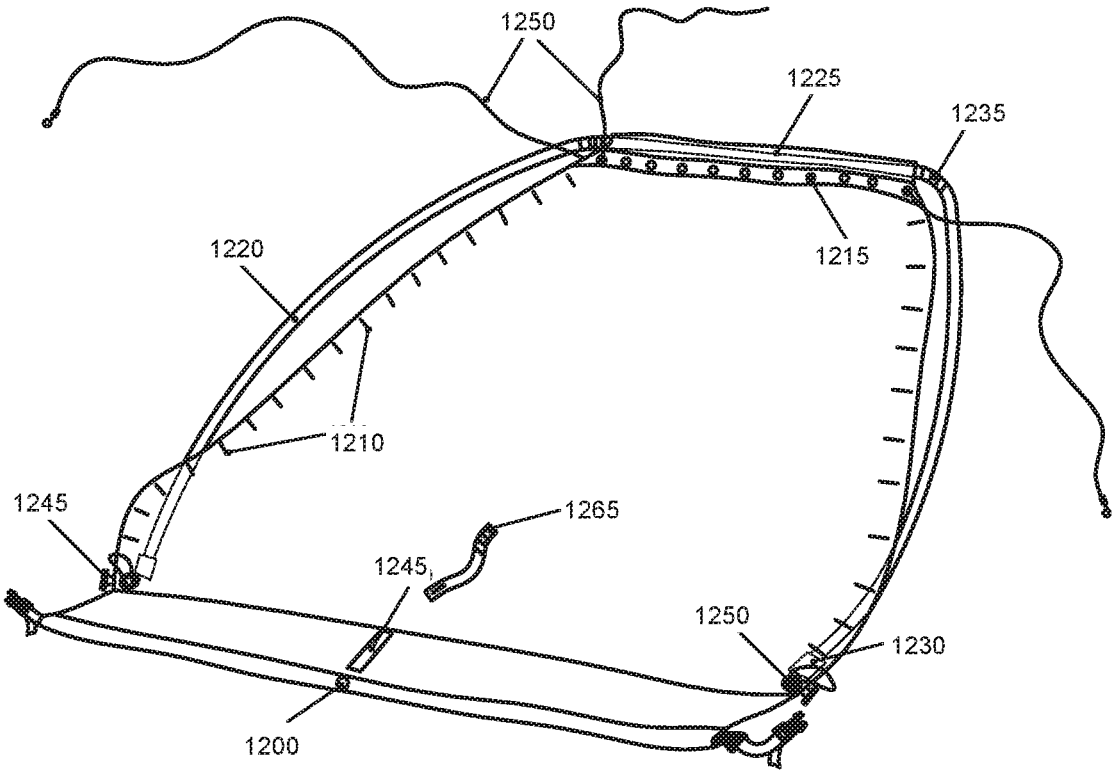
FIG. 12 is a front perspective view of an exemplary attachment system for a ball return device, in accordance with an embodiment of the present invention.

FIG. 12 is a front perspective view of an exemplary attachment system for a ball return device 1200, in accordance with an embodiment of the present invention. In the present embodiment, the attachment system comprises a lacing cord 1205 that may be laced around goal netting and the fabric of ball return device 1200 through hooks 1210 and grommets 1215. Structural framing members 1220 shaped to fit within a typical lacrosse goal slide into a fabric sleeve 1225 at the rear of ball return device 1200 and flex to fit into pockets 1230 on the underside of the front edge of ball return device 1200. Angled connection fittings 1235 connecting framing members 1220 aid in allowing framing members 1220 to flex enough to reach pockets 1230. The flexion of framing members 1220 typically puts an angled surface 1240 of ball return device 1200 under tension. Elastic cord ties 1245 may be inserted into grommets 1250 to attach ball return device to the goal posts of a goal. The present embodiment also comprises a retention flap 1255 that may be supported by a batten 1260 and a support strap 1265 that attaches to a fastener 1270 on retention flap 1255.

Figure 13:
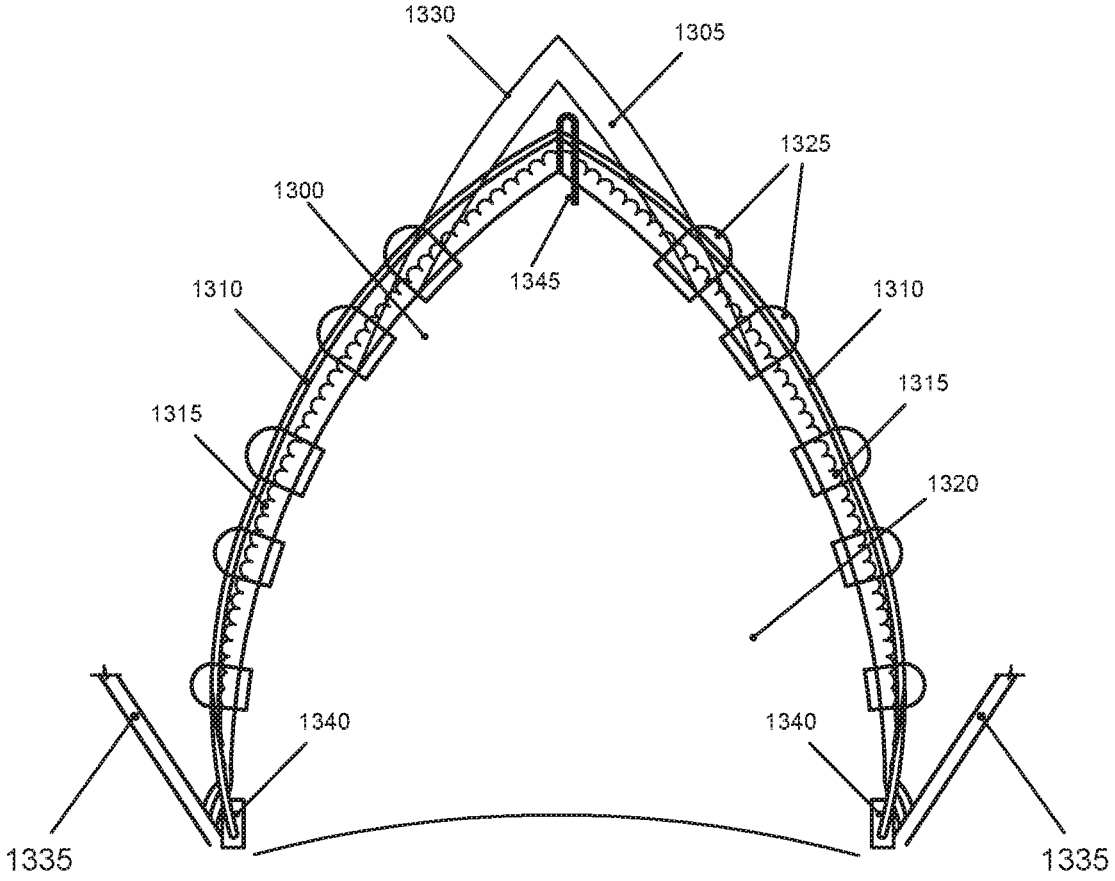
FIG. 13 is a diagrammatic top view of an exemplary attachment system for a ball return device connected to a goal, in accordance with an embodiment of the present invention.

FIG. 13 is a diagrammatic top view of an exemplary attachment system for a ball return device 1300 connected to a goal 1305, in accordance with an embodiment of the present invention. In the present embodiment, a structural frame 1310 for ball return device 1300 may be located outside of a goal netting 1315 while still supporting an angled surface 1320 on the interior of goal netting 1315. Connection means 1325 such as, but not limited to, metal rings, fabric loops, or elastic cords connect angled surface 1320 to structural frame 1310. Structural frame 1310 is shaped to fit within a typical lacrosse goal with a base frame 1330 and front goal posts 1335. Structural frame 1310 flexes so that the ends of structural frame 1310 fit into pockets or potentially to the goal frame itself 1340 at the front edge of ball return device 1300. A retaining strap 1345 may hold angled surface 1320 in place at the rear of netting 1315. Retaining strap 1345 may be secured using various different means including, without limitation, hook and loop material, elastic cord, snaps, and buttons. In order to install ball return device 1300, angled surface 1320 is placed inside netting 1315 at the desired location and connection means 1325 are pushed through spaces in netting 1315. Then, structural frame 1310 is slid through connection means 1325 from the rear of ball return device 1300 to the front where the ends of structural frame are fit into pockets 1340. Retaining strap 1345 may then be secured around structural frame 1310.

Figure 14:
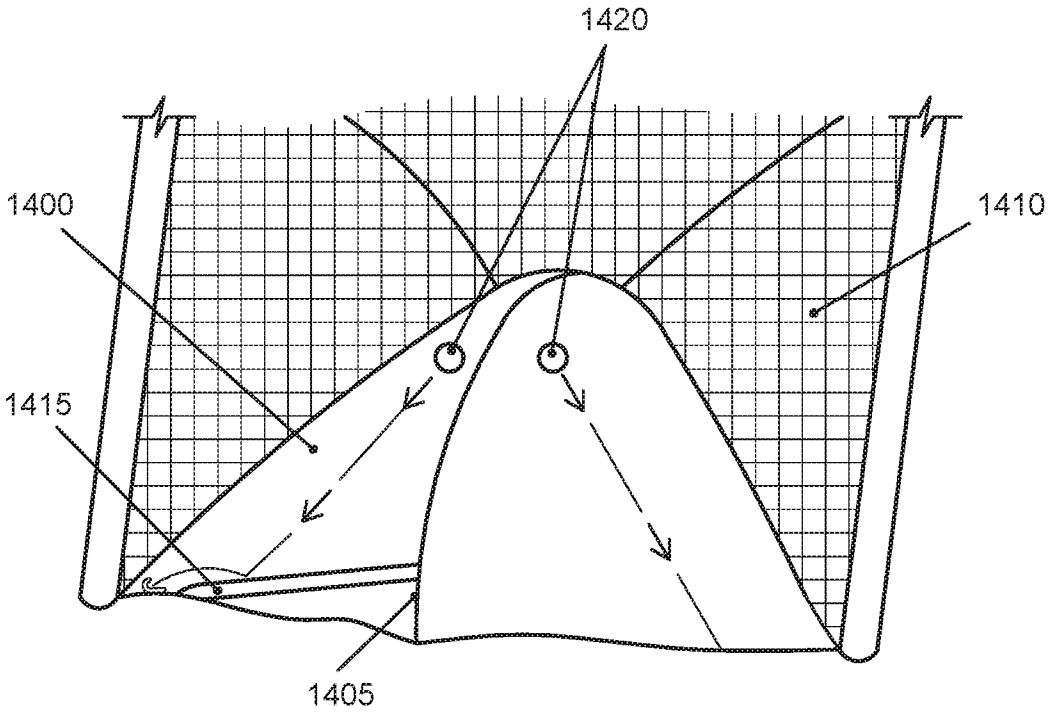
FIG. 14 is a front perspective view of an exemplary ball return device that may direct balls to the sides of a goal, in accordance with an embodiment of the present invention.

FIG. 14 is a front perspective view of an exemplary ball return device 1400 that may direct balls 1405 to the sides of a goal 1410, in accordance with an embodiment of the present invention. In the present embodiment, ball return device 1400 comprises a ridge pole 1405, or poles, in or in proximity the center of ball return device 1400 so that the fabric of ball return device 1400 slopes away from the center and toward the sides of goal 1410. Ridge pole 1405 may also help to maintain the tautness of ball return device, particularly in the center area. Ridge pole 1405 may be made of a flexible material that can be attached to ball return device 1400 in tension similar to a tent pole. Ridge pole 1405 may be attached to ball return device 1400 using various different means including, but not limited to, a pocket, pockets or sleeve formed into ball return device 1400, snaps, or adhesive. Ridge pole may be formed as a rounded pole or a substantially flat strip. Optionally, a raised guide 1415 made of fabric or another raised material such as, but not limited to, plastic or webbing may further direct balls 1420 to the side of goal 1405. Some embodiments may comprise more than one such guide. In typical use of the present embodiment, the angle of ball return device 1400 created by ridge pole 1405 and the front to back slope of ball return device 1400 typically causes balls 1420 to roll away from the center of ball return device 1400 and toward the opening of goal 1410 so that balls 1420 are typically directed to the sides of the opening of goal 1410. If one or more guides like raised guide 1415 are included such guides may further direct balls 1420 to the sides of goal 1410.

In one embodiment, the ball return device described herein may be integrated with a goal target training product. As described herein above, in the background section, currently there are several brands and designs of goal target training products available in the market. The goal target training products are typically fabric stretched across the entire goal entrance with holes placed to use as targets for shooting a ball through as an alternative to having a goalie defending the goal. These devices help players choose a place in the goal at which to shoot rather than shooting at a wide-open goal. These devices however block almost the entire entrance of the goal and make it quite challenging to remove balls that have "scored" or entered the goal. Many embodiments of the present invention may work well in conjunction with such devices as these embodiments typically allow balls to roll to the front of the goal or out under the target device where the balls may be quickly and easily collected.

Figure 15:
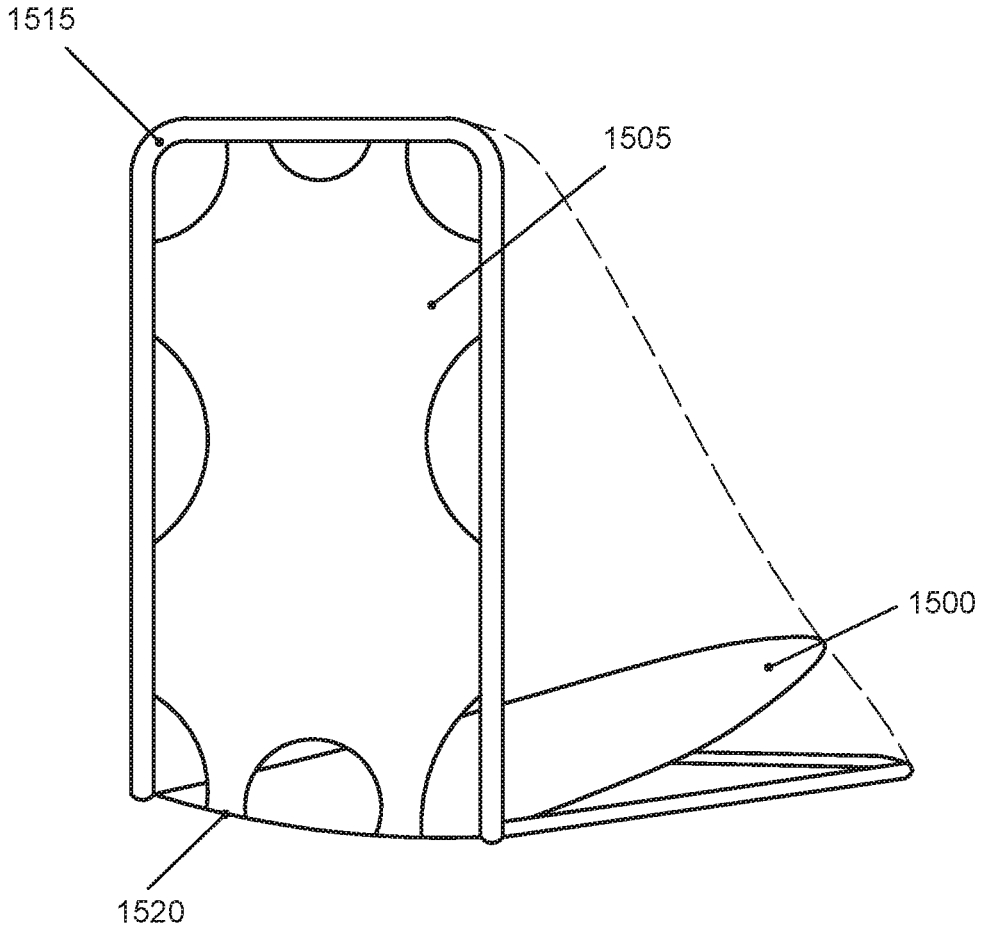
FIG. 15 is a side perspective view of an exemplary ball return device integrated into a target device, in accordance with an embodiment of the present invention.

Accordingly, FIG. 15 is a side perspective view of an exemplary ball return device 1500 integrated into a goal target device 1505, in accordance with an embodiment of the present invention. In the present embodiment, ball return device 1500 may be built into or attached to goal target device 1505 so that they form a one unit system. Ball return device 1500 and goal target device 1505 may be manufactured as one continuous piece of fabric that stretches across the opening of a goal 1515 front as target device 1505 then bends at a fold 1520 under and back into goal 1515 as ball return device 1500. In some embodiments ball return device 1500 and target device 1505 may be made as separate units that may be connected using various different connection means such as, but not limited to, sewing, snaps, hook and loop material, adhesive, or zippers.

Figure 16A:
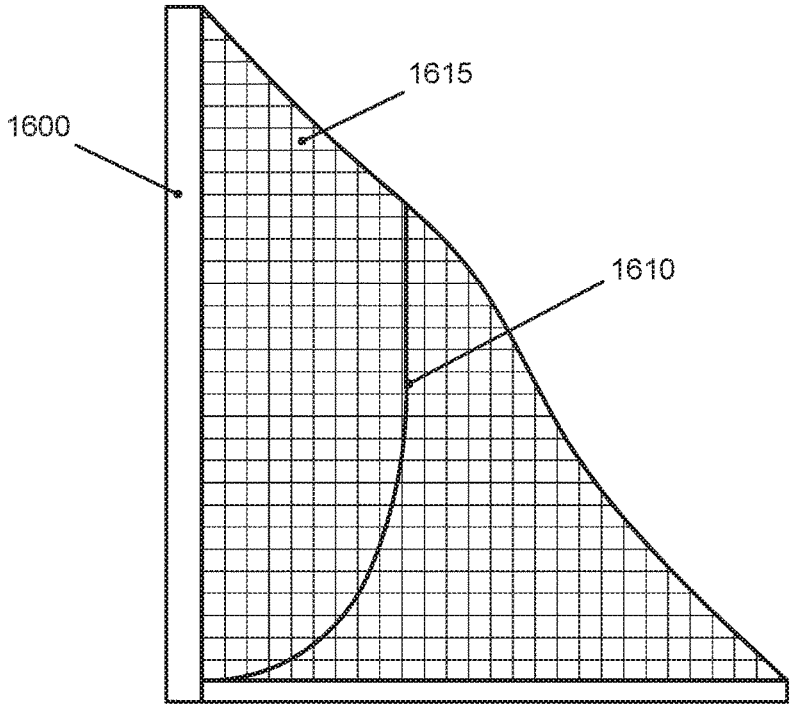
FIGS. 16A and 16B are side perspective views of an exemplary ball return device, in accordance with an embodiment of the present invention.

FIG. 16A is a side perspective view of a lacrosse goal 1600 where the exemplary ball return device 1610 design is integrated to and suspended from the goal netting 1615 only. Device fabric 1610 is shaped to fit the goal net 1615 shape of this cross section area of the net and will stop scored balls and roll them back onto the playing field.

Figure 16B:
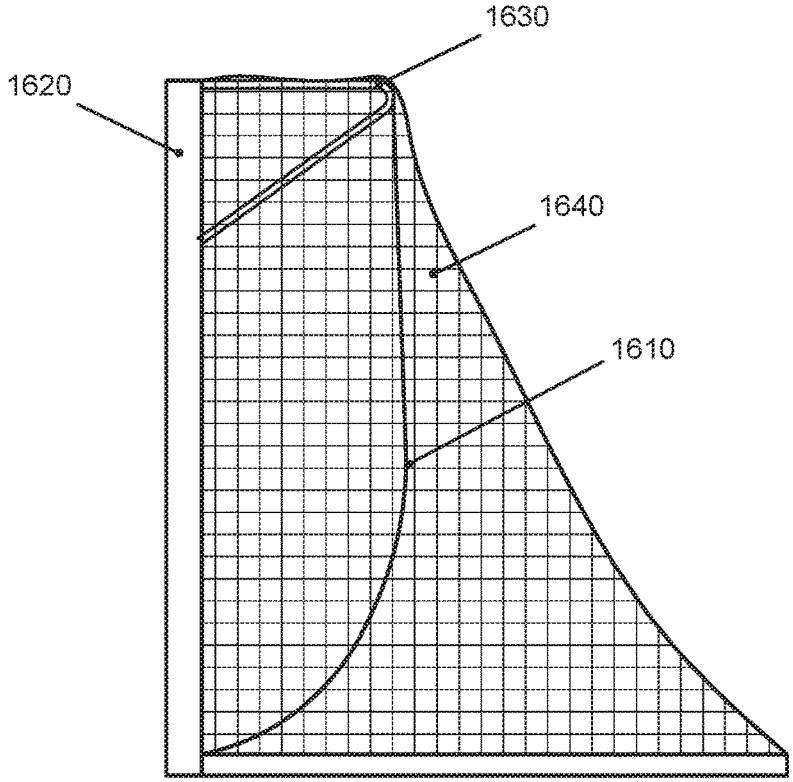

FIG. 16B is a side perspective of a soccer goal 1620 with an exemplary ball return device 1610 supported by the goal or net support frame 1630 or net support ropes or lines in other goal designs, where the ball return device may be primarily supported by the goal net 1640 and or net support structure. The designs illustrated in FIG. 16A and FIG. 16 B depict little or no device support frame.

Figure 17A:
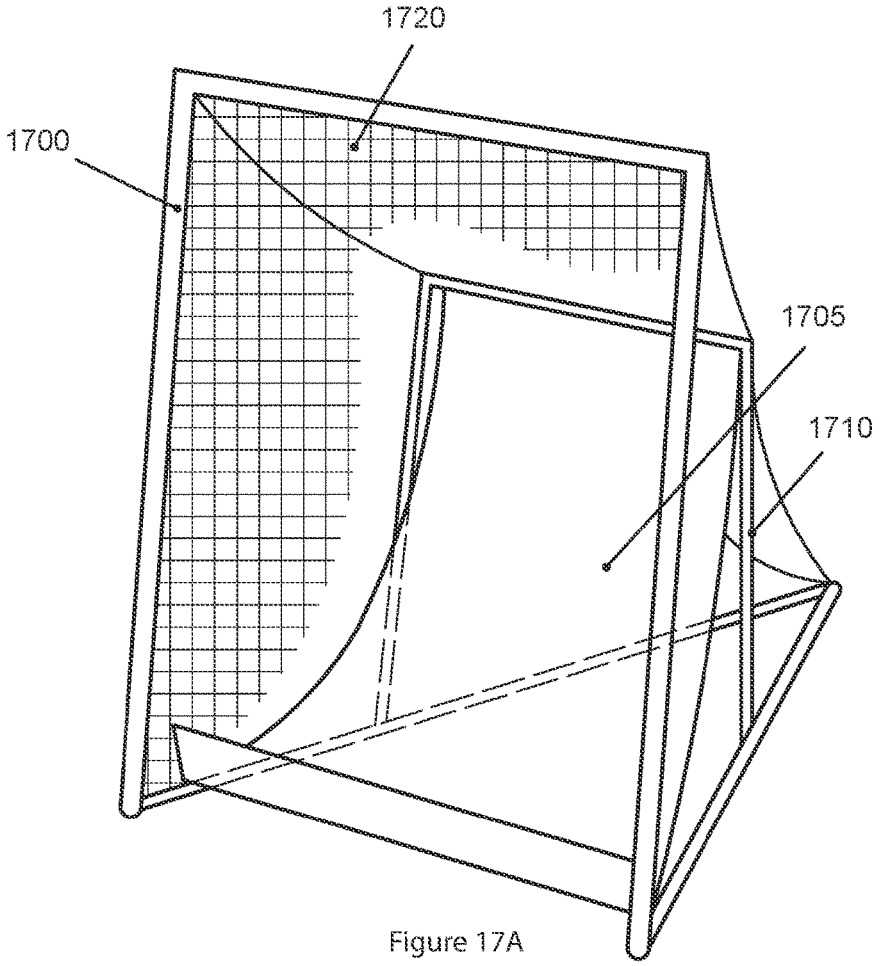
FIGS. 17A-C are front angled perspective views of an exemplary ball return device, in accordance with an embodiment of the present invention.
Figure 17B:
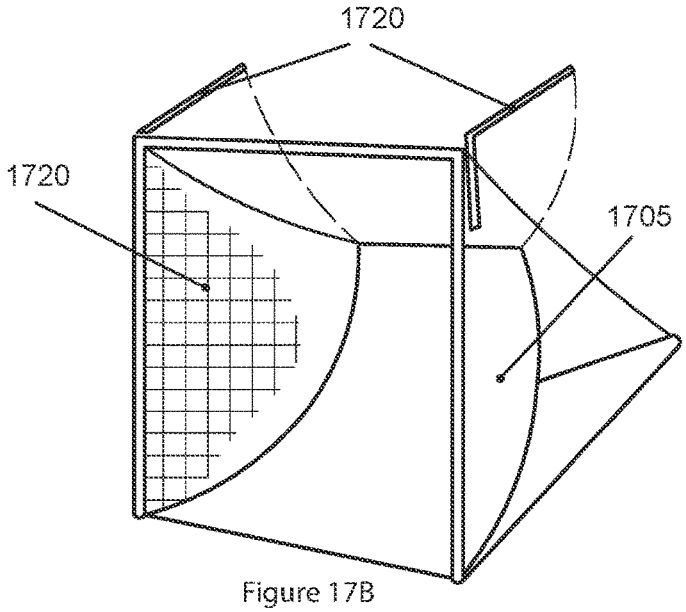
Figure 17C:
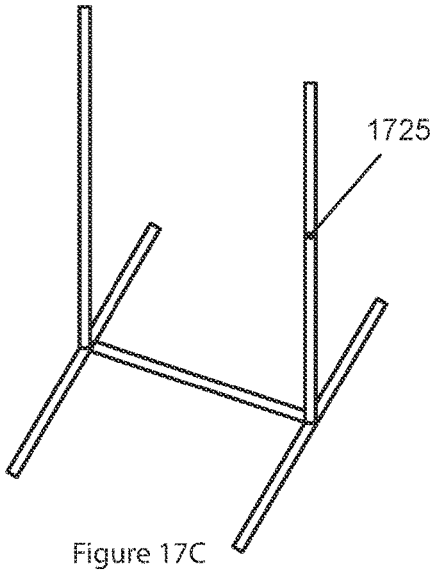

FIGS. 17A-C are front angled view views of an exemplary lacrosse goal 1700 with an exemplary ball return device 1705 similar as depicted in 16A but with the addition of a vertical device support frame 1710. The vertical frame poles in this exemplary device may rest on or be staked into the ground and may be inside or outside of the goal/net. Furthermore, the device frame may otherwise be free standing within or outside the goal/net with the vertical frame members connecting to horizontal base framing 1725(exemplary). Such frame may or may not have a top horizontal framing member as the upright frame members only may give the device support and shape. Framing/support brackets 1730 (exemplary) may also be clamped or otherwise affixed to goal posts and frame so to suspend the device from the brackets directly or with rope, line, elastic cord etc. In certain embodiments, the device described in FIGS. 16A, 16B and 17A-C may also be designed to integrate or connect to a goal target device stretched across the front of the goal entrance as described hereinabove with reference to FIG. 15.

Figures 18A, 18B:
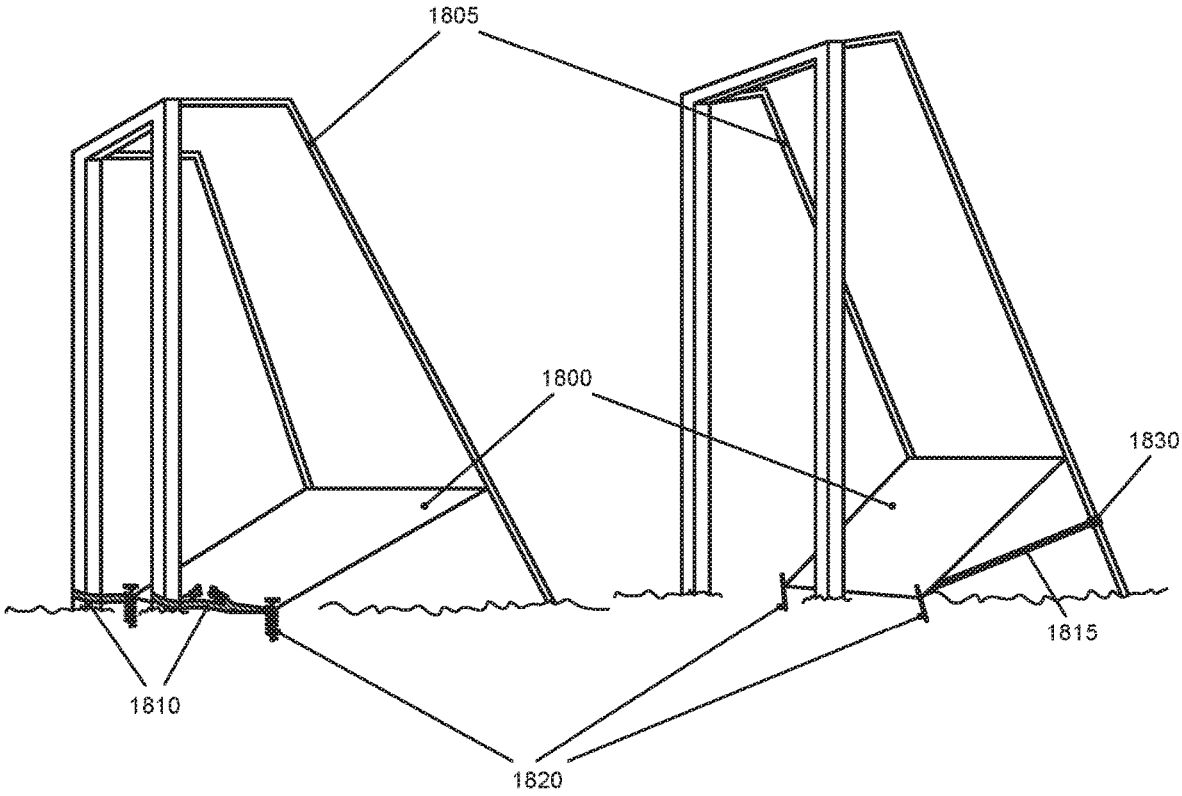
FIGS. 18A and 18B illustrate an exemplary attachment system for a ball return device connected to a goal, in accordance with an embodiment of the present invention.

Referring to FIGS. 18A and 18B is illustrated an exemplary attachment system for a ball return device connected to a goal, in accordance with an embodiment of the present invention. FIGS. 18A and 18B are a side angled perspective view of a goal in which the goal posts and goal/net support frame are buried into or secured into the ground with no horizontal ground level frame structure between the rear frame/net support and the goal posts. In this embodiment, a ball return device 1800 may be attached part way up the goal/net support frame 1805 at a rear position of the goal. In this embodiment, the ball return device 1800 may be placed substantially behind the goal posts and the goal line between the goal posts. FIG. 18A depicts tensioning straps 1810 that connect to the goal posts with enough length so as to allow a front edge of the ball return device to be placed substantially behind the goal line. Ball return device ground stakes or ground screws 1820 at front corners and front edge of the ball return device may assist the ball return device to fit to the ground as tightly as possible and provide proper shape and tension to the ball return device. FIG. 18B depicts the same goal type with an alternative device support and tensioning framing member 1815 and no device connection point to goal posts. In this embodiment, the device support/framing members may be affixed to the rear goal/net supports by an open bracket, clamp, strap, tie, bolt, etc. and may be connected at various points along the goal/net frame support 1805 between the ground and the device connection point on the goal/net frame supports. The device tension framing members may consist of rigid or flexible pole or pipe, it may be adjustable telescoping, and or with inner spring tension. The device tension framing members may attach to a front lower corner of the ball return device in a variety of manners including, but not limited to, bolts, clips, hook and grommet, strap, clamp, fabric pocket or sleeve etc. Ground stakes or ground screws 1815 may be used of hold the front of the ball return device tightly to the ground and properly taut across the surface of the ball return device. Those skilled in the art will readily recognize, in light of and in accordance with the teachings of the present invention, that some embodiments may be implemented in other suitable configurations from the foregoing embodiments. For example, without limitation, in some embodiments the angled surface of the device may be inflatable similar to a substantially flat raft. Other embodiments may be shaped like a wedge to fit into the back of a net in a similar sloping manner to the embodiments described in above. These web shaped embodiments may be inflatable or made of a solid piece of material such as, but not limited to, foam or a shaped fabric device with plastic or spring steel frame that is collapsible but "springs" into the proper shape when allowed to "uncoil" such as portable practice and training type goals like Pugg® Goals or Skilz® brand and other training goal manufacturers, or simple beach tents and other items that are commonly available. Similarly, the angled surface in some embodiments may be a substantially flat or wedge shaped cushion, similar to a vinyl boat cushion type of assembly. Furthermore, some embodiments may be implemented to be integrated into the actual sports goal and/or its netting as a more permanent component rather than as an accessory. It is contemplated that a multiplicity of suitable additional or alternative elements or features may be incorporated into some embodiments including, without limitation, a bag or enclosure into which balls may be funneled and collected as the balls exit a goal and carrying bags for the ball return device when uninstalled and in a folded position.

Figure 19A:
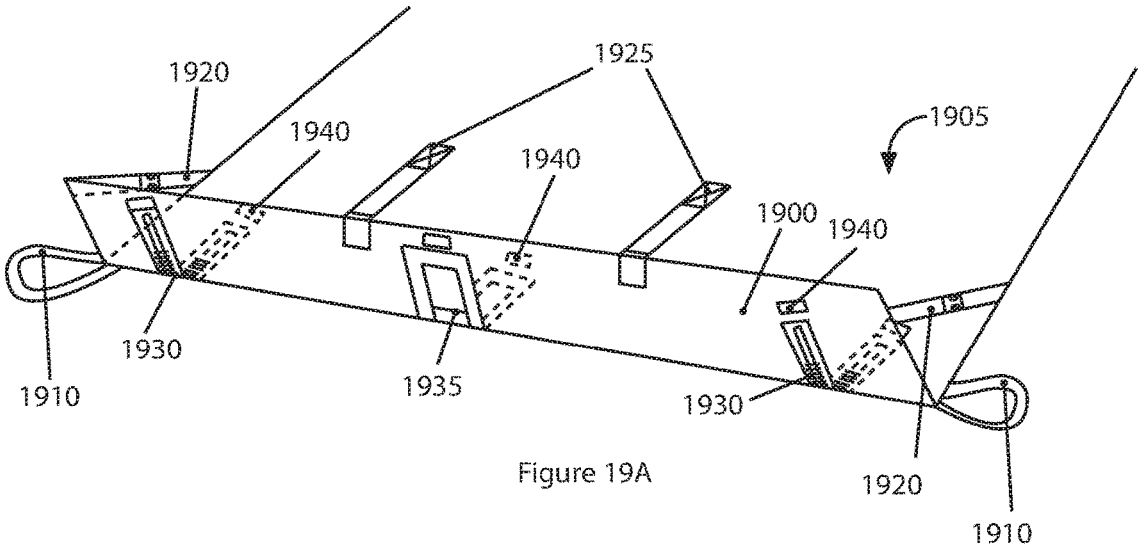
FIGS. 19A, 19B and 19C are perspective views of exemplary embodiments of ball retention flaps that may be integrated with ball return devices, in accordance with an embodiment of the present invention.
Figure 19B:
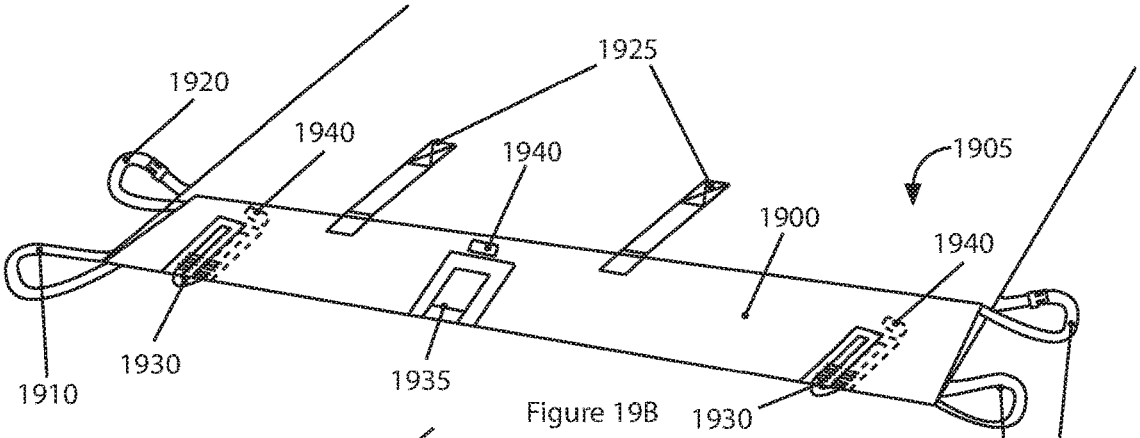
Figure 19C:
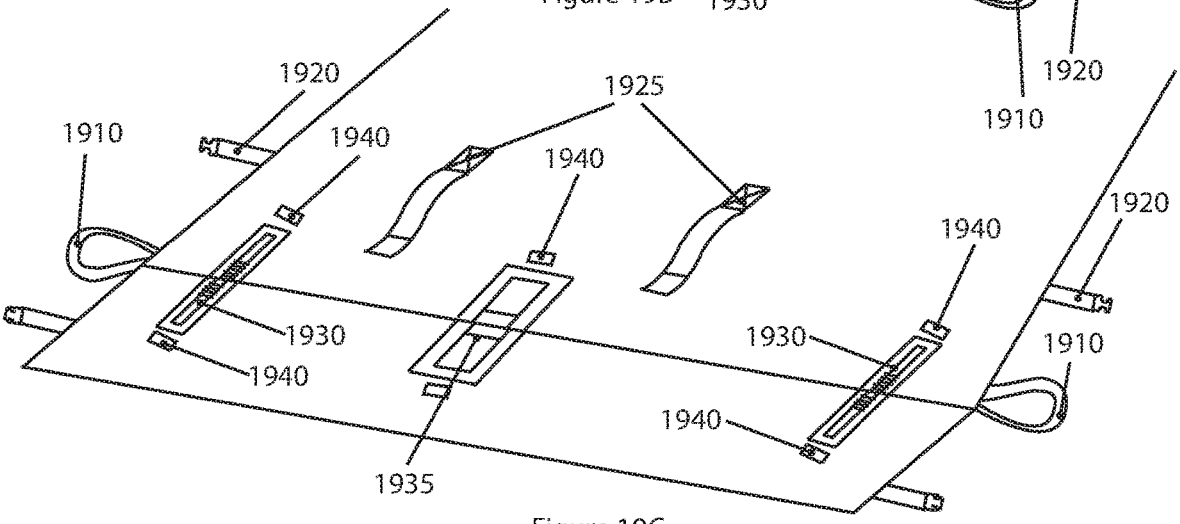

FIGS. 19A, 19B and 19C illustrate an exemplary ball retention flap 1900 of a ball return device 1905, in accordance with an embodiment of the present invention. In FIG. 19A, retention flap 1900 is shown in the up position held in place by straps 1925 and 1910. Strap 1920 is a strap with an adjustable quick connecting buckle, 1910 is a strap or bungee loop to attach bottom corners of device to the goal frame or ground stake, 1930 is a pocket which contains a spring hinge mechanism which acts to create a sharp angle in the fabric bend to help stop the rolling of balls, and which has ridged sections of fiberglass rod or similar on each side of a spring which prevents the fabric from folding over on itself and to hold the fabric upright, 1935 is a pocket which contains an alternative spring hinge mechanism which acts to create a sharp angle in the fabric bend to help stop the rolling of balls, and which has ridged sections of flat plastic or similar on each side of a spring which prevents the fabric from folding over on itself and to hold the fabric upright and optimal shape for stopping rolling balls. In FIG. 19B, retention flap 1900 is shown in the back position held in place by straps 1925, 1935 and Velcro tabs 1940. FIG. 19*c* shows the retention flab in an alternative forward release position.

Figure 20A:
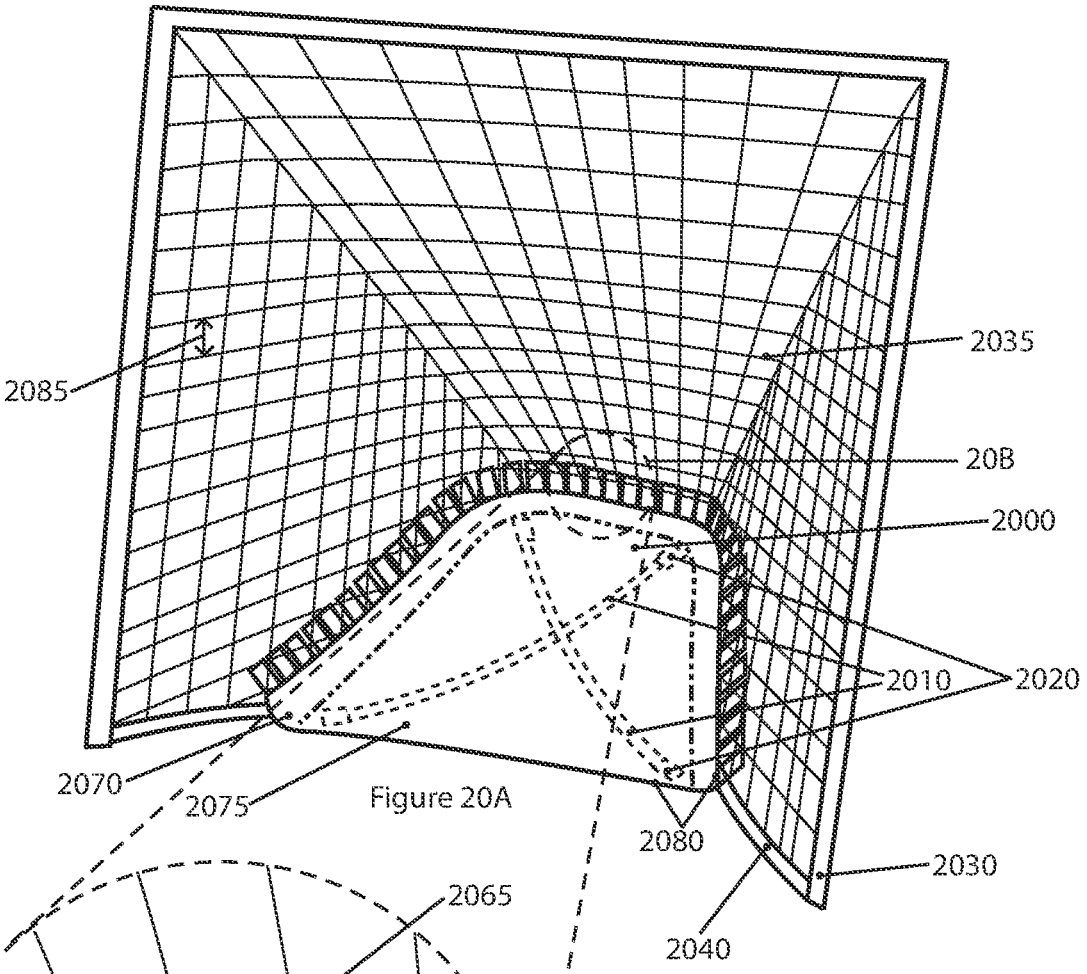
FIGS. 20A, 20B, 20C, 20D and 20E illustrate an exemplary in-goal ball return device in use in a goal, in accordance with an embodiment of the present invention.
Figure 20B:
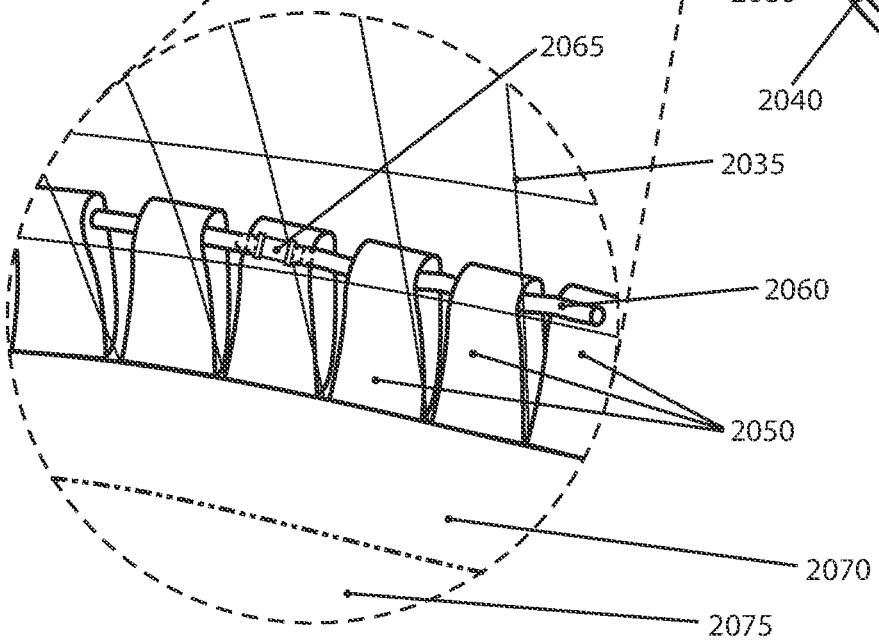
Figure 20C:
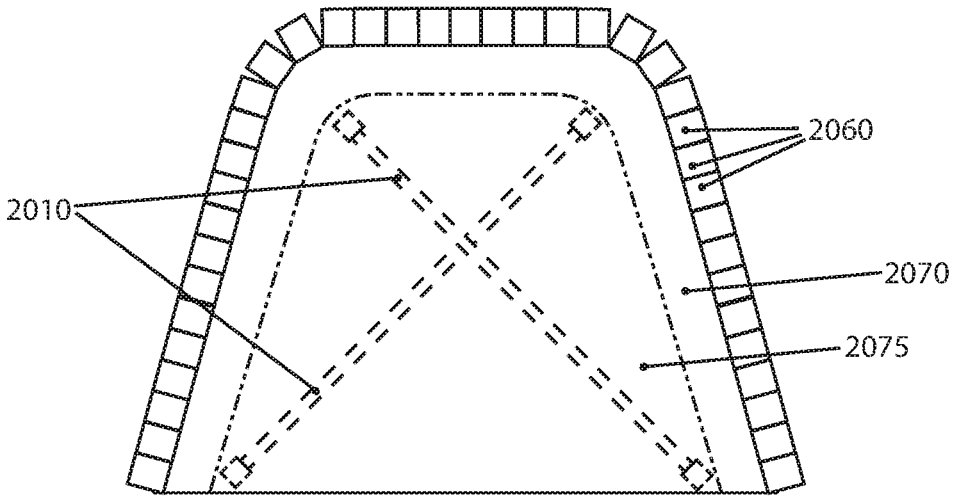
Figure 20D:
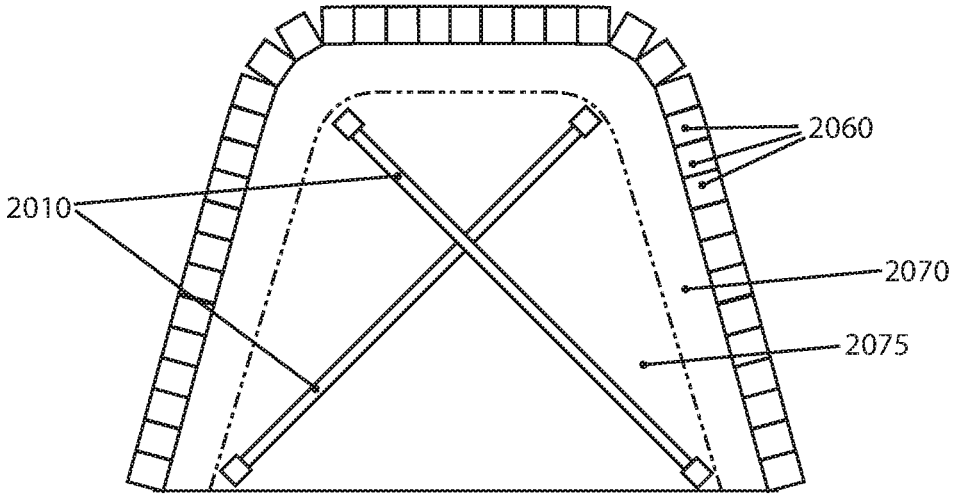
Figure 20E:
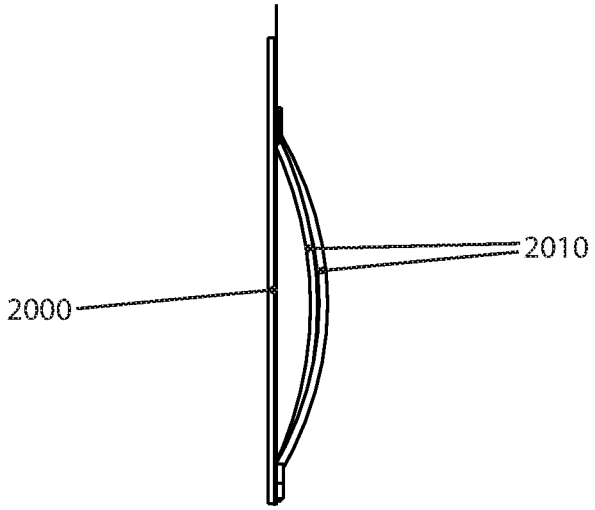

FIGS. 20A, 20B, 20C and 20D illustrate an exemplary in-goal ball return device 2000 in use in a lacrosse goal structure 2030, in accordance with an embodiment of the present invention. FIG. 20A is a front perspective view of lacrosse goal 2030 where the exemplary ball return device 2000 design is integrated to and suspended from the goal netting 2035. Ball return device 2000 is a material implement. Material implement has a front edge, side edges and a rear edge. Material implement includes at least one of a single and multi-piece system of fabric or fabric sections. The material implement narrows from the front to rear edge. It is understood that this narrowing occurs because the material implement is attached to a lacrosse goal. In other goal types, the material implement may not narrow. The goal has an inside goal securing area defined by the net and as indicated by line 2080 that outlines this area within the net. Material implement is larger than the inside of the net by an amount equal to a transition zone 2070. It is critical to have a transition zone 2070 that provides a smooth curved transition between the net 2035 and rest of the material implement when the material implement is laced to the net. The curved transition zone provides for smooth ball return that eliminates the possibility of a pocket forming between the implement or its frame and the net, which may trap a ball and prevent it from rolling out of the goal. The curved transition zone also provides less stresses on the ball return to net connection. Material implement 2000 has an active area 2075 surrounded by a transition zone. Reinforcing elements 2010 are integrated with the material implement to keep the material implement taught. Reinforcing elements may be at least one pair of rods with rod ends. Rods may be arranged as a bent cross, FIGS. 20C, 20D and 20E. Each rod end is attached to the material implement at reinforcement element connections 2020, which may be tension pole pocket. Each rod end is attached to the material implement within the active area to keep the active area taught. Reinforcing elements 2010 may be a frame attached to at least the back edge and two side edges of the material implement. A plurality of closed loops 2050 is disposed along the rear and side edges of the material implement, FIGS. 20A and 20B. Each closed loop 2050 may be formed from the fabric and the fabric folded upon itself to create each closed loop. Closed loops have a loop width that is the same of less than the width of the net mesh having a net mesh width 2085. Lacing cord 2060 is threaded through any number of the closed loops and the net to secure the material implement. Lacing cord 2060 is preferably a polymeric tube or elastomeric tube, but may be a solid cord. The elastomeric tube preferably has an outer tube diameter, wherein the elastomeric tube can stretch or flex three to fifteen times the outer diameter. When lacing cord 2060 is a tube, the lacing cord may also include the tube connectors. Connectors 2065 (tube connectors or cord connectors) are used between sections of tube or cord to extend the length of the lacing cord. The connectors are also used to change cord types for different flexibility or other properties within a length of cord. The connectors are also used to add angled or T, X or Y connections to the tube or cord. Connectors 2065 may be internal connectors, external connectors or other types of fittings. Ball return device 2000 may further include a retention flap (not shown) disposed on the front edge of the material implement. The retention flap has retention flap corners and a plurality of retention flap straps. Each of the plurality of retention flap straps is configured to secure the retention flap corners to an up position and prevent a ball hitting the net from rolling out of the goal.

Figure 21:
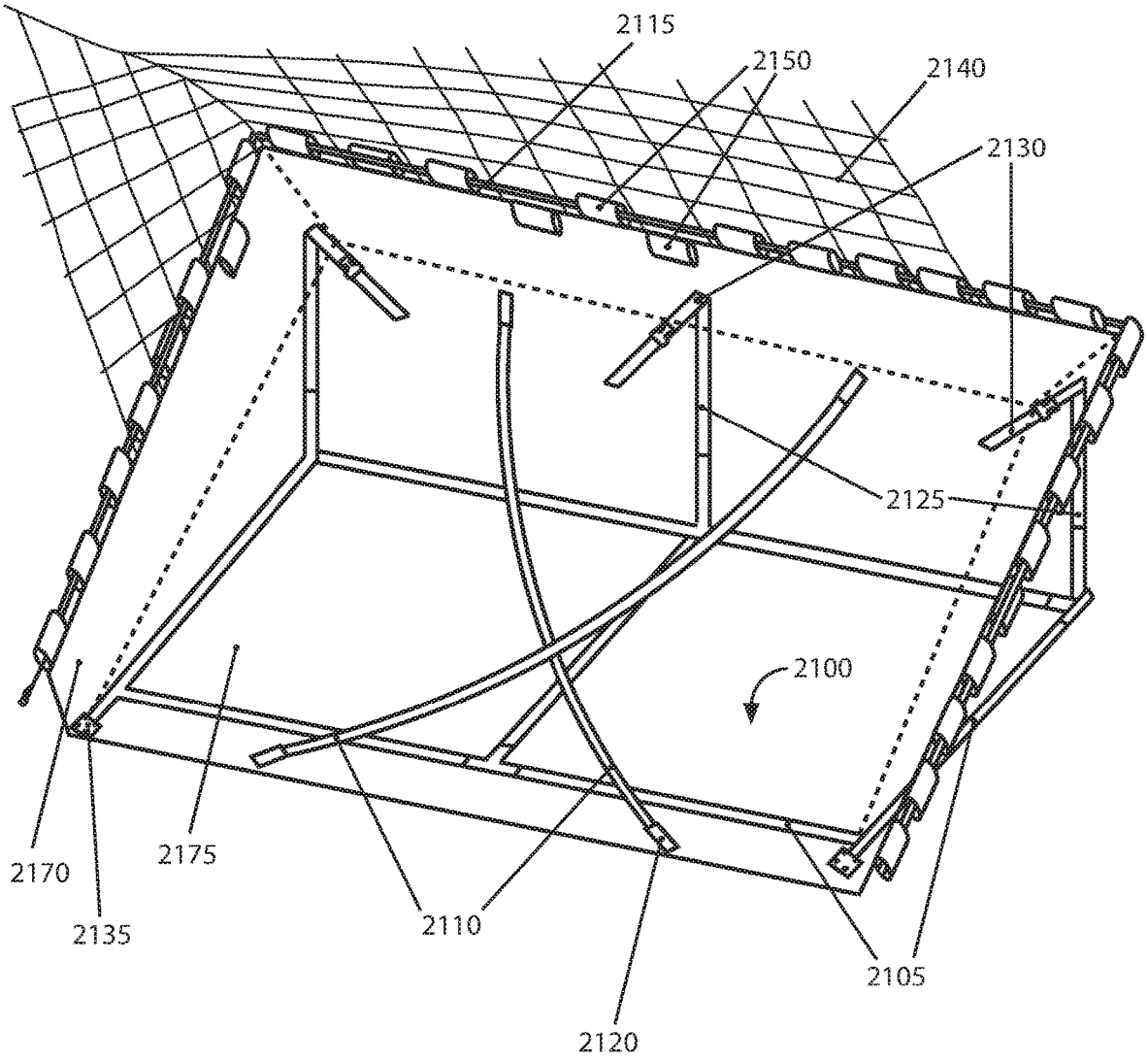
FIG. 21 is a perspective view of an exemplary ball return device where the implement is supported completely by its own frame and the fabric implement does not have any attachment points to the goal frame but only attaches to the goal netting where the implement maintains a flat angled surface towards the front of the goal.

FIG. 21 illustrates an exemplary in-goal ball return device 2100 in use in a soccer goal structure, in accordance with an embodiment of the present invention. FIG. 21 is a front perspective view of soccer goal where the exemplary ball return device 2100 design is integrated with goal netting 2140 and supported by a frame 2105. Ball return device 2100 is a material implement. Material implement has a front edge, side edges and a rear edge. Material implement includes at least one of a single and multi-piece system of fabric or fabric sections. Material implement has a transition zone 2170. Material implement 2100 has an active area 2175 surrounded by a transition zone. Reinforcing elements 2110 are integrated with the material implement to keep the material implement taught. Reinforcing elements may be at least one pair of rods with rod ends. Each rod end is attached to the material implement at reinforcement element connections 2120. Each rod end is attached to the material implement within the active area to keep the active area taught. Reinforcing elements may include a frame comprised of frame base sections 2105 and vertical sections 2125. Strap fasteners 2130 are used to stretch the material implement in the active area. Tension pole pockets 2120 are provided that maintain the shape and tautness of the fabric without the need to attach to the goal frame. A plurality of closed loops 2150 is disposed along the rear and side edges of the material implement. Lacing cord 2115 is threaded through any number of the closed loops and the net to secure the material implement. Lacing cord 2115 is preferably a polymeric tube or elastomeric tube. Ball return device 2100 may further include a retention flap (not shown) disposed on the front edge of the material implement.

Figure 22:
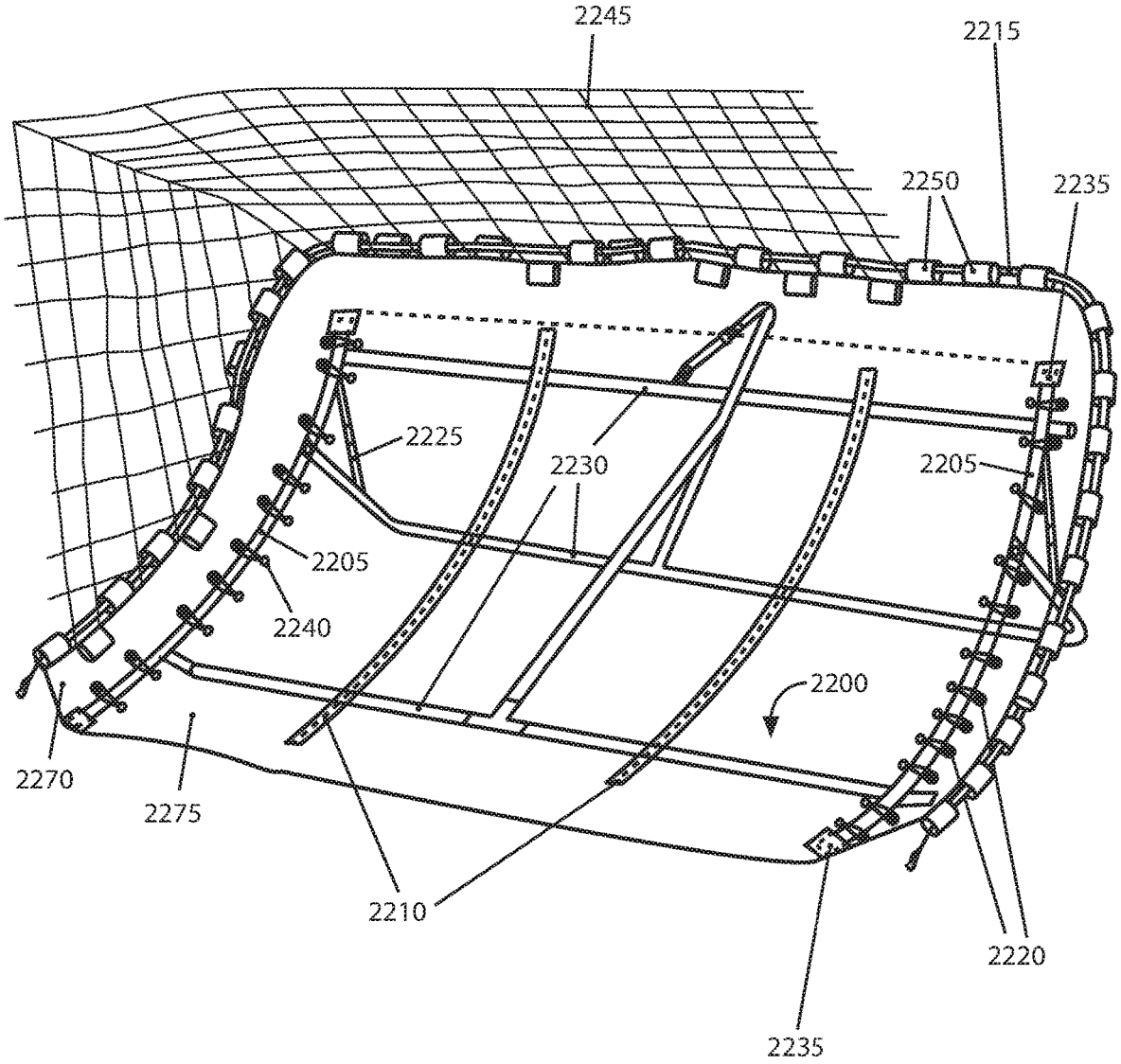
FIG. 22 is a perspective view of an exemplary ball return device where the implement is supported completely by its own frame and the fabric implement does not have any attachment points to the goal frame but only attaches to the goal netting and where the implement fabric maintains a curved shape from the front of the goal to the back.

FIG. 22 illustrates an exemplary in-goal ball return device 2200 in use in a soccer goal structure, in accordance with an embodiment of the present invention. FIG. 22 is a front perspective view of soccer goal where the exemplary ball return device 2200 design is integrated with goal netting 2245 and supported by a frame 2230. Ball return device 2200 is a material implement. Material implement has a front edge, side edges and a rear edge. Material implement includes at least one of a single and multi-piece system of fabric or fabric sections. Material implement has a transition zone 2270. Material implement 2200 has an active area 2275 surrounded by a transition zone. Material element is supported by curved side framing members 2205, horizontal framing members 2230 and vertical framing members 2225. Connection to the frame is by way of grommet holes 2240 for bungee connection. Reinforcing elements 2210 (battens and batten pockets or sleeves) are integrated with the material implement to keep the material implement taught. Reinforcing elements may be at least one pair of rods with rod ends. Each rod end is attached to the material implement at reinforcement element connections 2235 (pockets for frame insertion). Each rod end is attached to the material implement within the active area to keep the active area taught. A plurality of closed loops 2250 is disposed along the rear and side edges of the material implement. Lacing cord 2215 is threaded through any number of the closed loops and the net to secure the material implement. Lacing cord 2215 is preferably a polymeric tube or elastomeric tube, but may be a solid cord. Ball return device 2200 may further include a retention flap (not shown) disposed on the front edge of the material implement.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing an in-goal ball return device according to the present invention will be apparent to those skilled in the art. Various aspects of the invention have been described above by way of illustration, and the specific embodiments disclosed are not intended to limit the invention to the particular forms disclosed. The particular implementation of the ball return device and sport net lacing system may vary depending upon the particular context or application. By way of example, and not limitation, the ball return devices described in the foregoing were principally directed to non-rigid implementations; however, similar techniques may instead be applied to ball return devices made of more rigid materials such as, but not limited to, corrugated plastic, foam, or cardboard, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device for placement within a goal to return balls, the goal including a frame for supporting a net mesh having a net mesh width, the goal having an inside goal securing area defined by the net, the net used for securing the device to the goal; comprising:

a) a material implement, wherein the material implement has a front edge, side edges and a rear edge, the material implement includes at least one of a single and multi-piece system of fabric or fabric sections;

b) a plurality of closed loops are formed from the fabric and disposed along the rear edge and side edges of the material implement, the fabric folded to create each closed loop, the closed loops secured to the rear edge and side edges of the material implement; and c) a lacing cord for threading through any number of the closed loops and the net to secure the material implement to the net.

2. The device as recited in claim 1, wherein the material implement narrows from the front to rear edge.

3. The device as recited in claim 1, wherein the material implement has an active area surrounded by a transition zone on the rear edge and side edges where the material implement interfaces with the net, wherein the active area is substantially equal to the inside goal securing area, wherein the transition zone is extra fabric extending outward from the active area towards the closed loops, wherein the transition zone provides a smooth curved transition between the net and the active area when the material implement is laced to the net.

4. The device as recited in claim 1, wherein the closed loops have a loop width that is substantially the same width as the net mesh width.

5. The device as recited in claim 1, wherein the material implement has an active area surrounded by a transition zone on the rear edge and the side edges, wherein the active area is substantially equal to the inside goal securing area, further comprising a reinforcing element integrated to span across the active area of the material implement to keep the active area taught.

6. The device as recited in claim 5, wherein the reinforcing element is at least one pair of rods with rod ends that form a cross, wherein each rod end is attached to the material implement within the active area and spans across the active area to keep the active area taught.

7. The device as recited in claim 1, further comprising a reinforcing element, wherein the reinforcing element is a support frame attached to at least the back edge and two side edges of the material implement.

8. The device as recited in claim 1, wherein the lacing cord is one or more sections of tube.

9. The device as recited in claim 1, wherein the lacing cord is an elastomeric tube.

10. The device as recited in claim 9, wherein the elastomeric tube has an outer tube diameter, wherein the elastomeric tube can stretch three to fifteen times the outer diameter.

11. The device as recited in claim 8, wherein the lacing cord includes connectors, wherein the connectors are used between sections of tube to extend the length of the lacing cord.

12. The device as recited in claim 1, wherein the lacing cord is two or more sections of cord with different mechanical properties, wherein each section of cord is connected together by a connector.

13. The device as recited in claim 1, further comprising a retention flap disposed on the front edge of the material implement, wherein the retention flap comprises additional fabric that is configured to adjust in an up position to prevent the ball from rolling back out of the goal.

14. The device as recited in claim 13, wherein the retention flap has retention flap corners and a plurality of retention flap straps, each of the plurality of retention flap straps is configured to secure the retention flap corners to a higher position than the inside goal securing area to prevent the ball from rolling out of the goal.

15. A sport net lacing system; comprising:

a) a net mesh, the mesh having strands of material defining open spaces;

b) an elastomeric tube;

c) a frame having net fastening elements permanently affixed directly to the frame without the use of the elastomeric tube to hold the net fastening elements to the frame;

d) wherein the elastomeric tube is for threading through any number of the open spaces and the net fastening elements to connect the net mesh to the frame; and e) wherein the elastomeric tube is a plurality of sections of elastomeric tubes, wherein each section includes a hollow core, wherein the elastomeric tube includes one or more interior tube connectors, wherein each interior tube connector fits within the hollow core of two sections to create a connection, wherein multiple sections are connected to extend the length of the elastomeric tube.

16. The lacing system as recited in claim 15, wherein the net fastening elements are a coil of wire welded periodically to the frame.

17. A sport net lacing system for a goal having net connection areas; comprising:

a) a first net mesh, the first net mesh having strands of material defining first open spaces;

b) a second net mesh, the second net mesh having strands of material defining second open spaces;

c) an elastomeric tube for threading through any number of the first and second open spaces to secure the first and second nets together; and d) wherein the elastomeric tube is a plurality of sections of tubes, wherein each section includes a hollow core, wherein the elastomeric tube includes one or more interior tube connectors, wherein each interior tube connector fits within the hollow core of two sections of tube to create a connection, wherein multiple tube sections are connected to extend the length of the elastomeric tube.

18. The lacing system as recited in claim 15, wherein the at least one or more interior tube connectors are at least one from the group including a T, X and Y connector.

19. The lacing system as recited in claim 17, wherein at least one of the plurality of sections of tubes has different properties.

* * * * *